US005111741A

United States Patent [19]

Weder et al.

[11] Patent Number: 5,111,741

[45] Date of Patent: May 12, 1992

[54] SYSTEM FOR BALING STRANDS OF MATERIAL INCLUDING MEANS FOR FEEDING AND MEANS FOR WEIGHING MATERIAL CHARGES

[75] Inventors: Donald E. Weder; Erin H. Weder, both of Highland, Ill.

[73] Assignee: Highland Supply Corporation, Highland, Ill.

[21] Appl. No.: 733,046

[22] Filed: Jul. 19, 1990

Related U.S. Application Data

[60] Division of Ser. No. 640,566, Jan. 14, 1991, abandoned, which is a continuation of Ser. No. 499,222, Mar. 26, 1990, abandoned, which is a continuation of Ser. No. 270,779, Nov. 7, 1988, Pat. No. 4,961,375, which is a division of Ser. No. 605,386, Apr. 30, 1984, Pat. No. 4,884,682.

[51] Int. Cl.[5] ..... B30B 15/30; B30B 15/10; B30B 5/00

[52] U.S. Cl. ..... 100/45; 100/49; 100/52; 100/99; 100/141; 100/215; 100/218; 100/219; 100/232; 100/246; 100/253

[58] Field of Search ..... 100/43, 45, 48-53, 100/99, 137-139, 141-143, 179, 189, 215, 218, 219, 232, 246, 253, 256; 141/73, 83

[56] References Cited

U.S. PATENT DOCUMENTS

| | | | |
|---|---|---|---|
| 3,161,124 | 12/1964 | Strömberg | 100/45 |
| 3,538,364 | 9/1970 | Freund | 100/219 X |
| 3,721,060 | 3/1973 | Quinto | 100/49 X |
| 3,802,335 | 4/1974 | Longo | 100/49 X |
| 3,895,572 | 7/1975 | Nitschke | 100/49 X |
| 4,040,230 | 8/1977 | Pessel et al. | 100/99 X |
| 4,526,094 | 7/1985 | Rewitzer | 100/45 X |
| 4,961,375 | 10/1990 | Weder et al. | 100/45 |

FOREIGN PATENT DOCUMENTS

| | | | |
|---|---|---|---|
| 777113 | 6/1957 | United Kingdom | 100/141 |
| 1384080 | 2/1975 | United Kingdom | 100/99 |

*Primary Examiner*—Harvey C. Hornsby
*Assistant Examiner*—Stephen F. Gerrity
*Attorney, Agent, or Firm*—Dunlap, Codding & Lee

[57] ABSTRACT

A system for baling strands of material wherein a predetermined quantity of strands of material is compressed into a bale of strands of material having a density of at least about 14 pounds per cubic foot and having a substantial portion of the bale unmatted, the system being particularly useful for baling easter grass. The system includes a baler wherein the strands of material are compressed in a substantially enclosed portion of the baler to form the bale of material. In the system, a predetermined weight comprising a portion of the total desired weight of a bale of material is compressed, and additional portions are added and compressed until the total desired weight has been compressed into a bale of material.

11 Claims, 5 Drawing Sheets

SYSTEM FOR BALING STRANDS OF MATERIAL INCLUDING MEANS FOR FEEDING AND MEANS FOR WEIGHING MATERIAL CHARGES

This is a divisional of co-pending application Ser. No. 640,566 filed on Jan. 14, 1991 now abandoned, which is a continuation of U.S. Ser. No. 499,222, filed Mar. 26, 1990, now abondoned, which is a continuation of U.S. Ser. No. 270,779, files Nov. 11, 1988, now U.S. Pat. No. 4,961,375, which is a divisional of U.S. Ser. No. 605,386 filed Apr. 30, 1984, now U.S. Pat. No. 4,884,682.

BACKGROUND OF THE INVENTION

1. Field of the Invention

The present invention generally contemplates a system for baling strands of material and, more particularly, but not by way of limitation, to a system for baling strands of material to produce a bale of strands of material having greater density as compared to prior bales of the same materials. The present system particularly is adapted for baling Easter grass and Easter grass like material and, in this instance, the bales so produced have a density of at least about 14 pounds per cubic foot and the Easter grass material is separated from the bale in a relatively easy manner and a substantial portion of the Easter grass so separated is unmatted.

BRIEF DESCRIPTION OF THE DRAWINGS

FIG. 10 is a schematic view similar to FIGS. 8 and 9, but showing another portion of the controls used for operating the system of the present invention.

DESCRIPTION OF THE PREFERRED EMBODIMENTS

Figure 1:
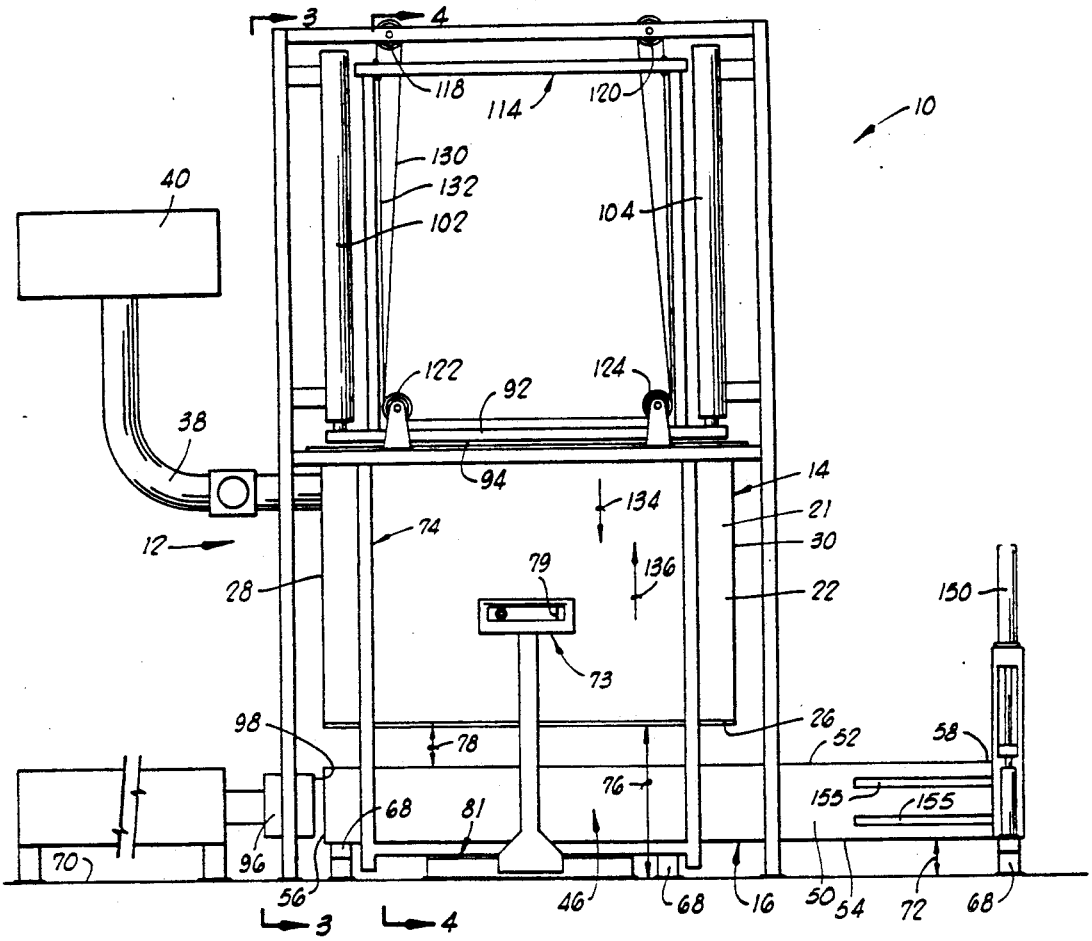
FIG. 1 is a side elevational view of a baler which is constructed and which operates in accordance with the present invention.

Shown diagrammatically and schematically in FIG. 1 is a system 10 which is constructed in accordance with the present invention for producing bales of strands of material. The term "strands of material" as used herein means stringy material, strips or strip-like material, such as material commonly referred to as Easter grass, for example, and in general, any material which tends to become matted when baled due, at least in part, to either or both the structure of material or the nature of the composition of such material, such material having a substantially low elastic limit so that, when such strands of material are deformed by compression, such deformation substantially becomes set in such strands and such strands of material having a substantially low tensile strength. The present system particularly is adapted to bale Easter grass, and the term "Easter grass" and the term "strands of material" as used herein means an artificial strand of grass-like material produced from a plastic or plastic-like material, such materials being selected from a group of materials comprising: cellophane, paper, organic polymers such as polypropylene, for example, or polystyrene or combinations thereof, for example, and each strand of material of the type contemplated by the present invention having a length generally in a range from about 3 to about 20 inches, a width in a range generally from about 1/64 inch to about ¼ inch and a thickness generally in a range from about 0.0004 inches to about 0.004 inches.

The system 10 inches a baler 12 comprising a weighing station 14 and a pressing station 16. In general, the strands of material to be baled are passed into the weighing station 14 and, when the total weight of the material to be baled in the weighing station 14 has reached a predetermined weight, the material in the weighing station 14 is passed into the pressing station 16 where the material to be baled is compressed into a bale of the material. The compressed material (the bale of material) in the pressing station 16 then is tied to retain the material in a bale of material form and the tied bale of material is discharged then from the pressing station 16.

As shown more clearly in FIGS. 1 through 5, the weighing station 14 includes a weighing container 21 which generally is rectangularly shaped and includes a first and a second side wall 20 and 22, an upper and a lower end wall 24 and 26, and a first and a second end wall 28 and 30. The walls 20, 22, 24, 26, 28 and 30 each have inner surfaces, and the walls 20, 22, 24, 26, 28 and 30 are interconnected to form a generally rectangularly shaped structure with the inner surface of the 20, 22, 24, 26, 28 and 30 cooperating substantially to encompass and enclose a generally rectangularly shaped material receiving space 32 (shown in FIGS. 4 and 5).

A receiving opening 34 (shown in FIG. 3) is formed through the first side wall 20, generally near the upper end wall 24, and the receiving opening 34 extends through the first side wall 20 and is in communication with the material receiving space 32 in the weighing container 21. A generally rectangularly shaped discharge opening 36 (shown in FIGS. 4 and 5) is formed through the lower end wall 26 and the discharge opening 36 is in communication with the material receiving space 32 in the weighing container 21. The discharge opening 36 extends generally between the first and second side walls 20 and 22 and generally between the first and second end walls 28 and 30.

Figure 3:
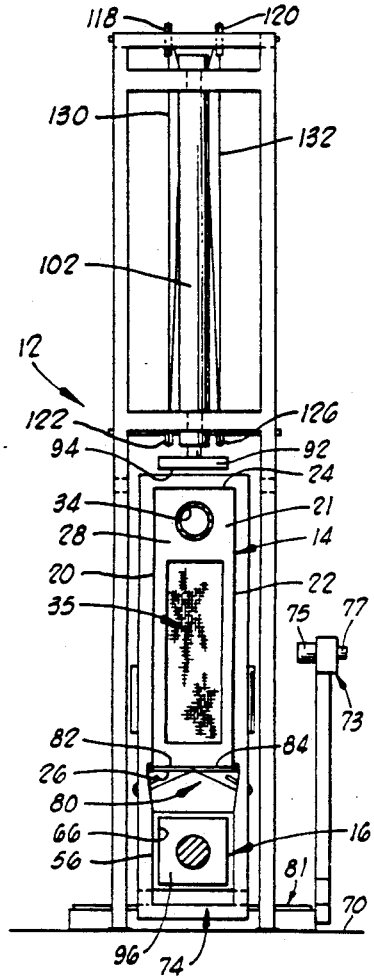
FIG. 3 is a sectional view (partial end elevational) of the baler of the present invention, taken substantially along the lines 3—3 of FIG. 1.
Figure 4:
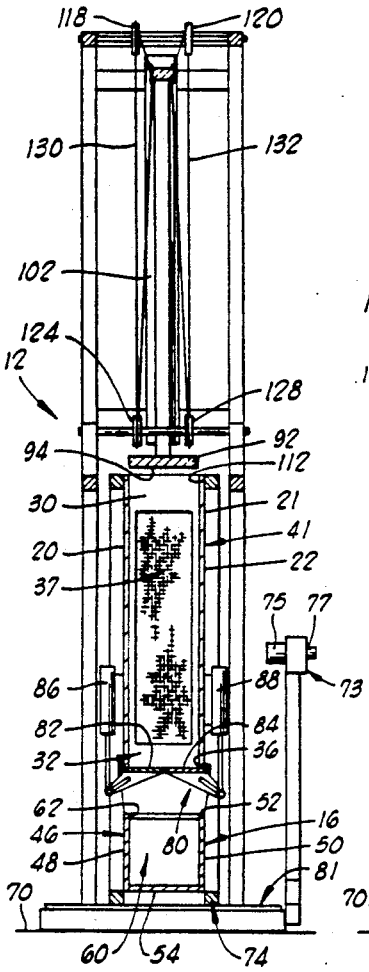
FIG. 4 is a sectional view (partial end elevational) of the baler of the present invention, taken substantially along the lines 4—4 of FIG. 1 and showing the upper pressing assembly in a storage position.
Figure 5:
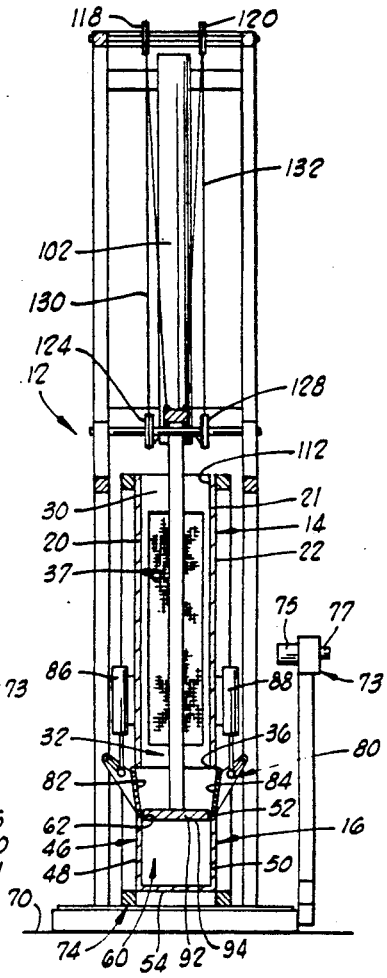
FIG. 5 is a view similar to FIG. 4, but showing the upper pressing assembly in the engaging position.

As shown in FIG. 3 an opening is formed through the first end wall 28 and a filter screen 35 is secured to the first end wall 28, the filter screen 35 extending generally over the opening formed in the first end wall 28. As shown in FIGS. 4 and 5, an opening is formed through the second end wall 30 and a filter screen 37 is secured to the second end wall 30, the filter screen 37 extending generally over the opening formed through the second end wall 30. The openings and the filter screens 35 and 37 cooperate to permit air to pass from the material receiving space 32 while simultaneously retaining the material to be baled within the material receiving space 32.

The material receiving space 32 is adapted and shaped for receiving and temporarily retaining material to be baled and the receiving opening 34 is adapted for receiving material to be baled and for passing such material to be baled into the material receiving space 32. The discharge opening 36 is adapted, shaped and positioned for discharging the material to be baled from the material receiving space 32 through the discharge opening 36, during the operation of the system 10 of the present invention.

One end of an inlet conduit 38 is connected to the receiving opeining 34 and the inlet conduit 38 also is connected to a material source 40. The material source 40 includes a supply of the material to be baled and, in one operable embodiment, also includes a blower for blowingly passing the material through the inlet conduit 38, through the receiving opening 34 and into the material receiving space 32.

An inlet door 42 is interposed in the inlet conduit 38 and the inlet door 42 is movably supported in the inlet conduit 38 for movement from an opened position to a closed position and from a closed position to an opened position. A hydraulic cylinder 44 is connected to the inlet door 42, and the hydraulic cylinder 44 is constructed and adapted to move the inlet door 42 to the opened and closed positions. In the closed position, the inlet door 38 substantially closes the inlet conduit 38 to prevent material from passing from the material source 40 into the material receiving space 32 and, in the opened position, the inlet door 42 establishes communication through.the inlet conduit 38 so material can be passed from the material source 40, through the inlet conduit 38 and into the material receiving space 32.

Figure 11:
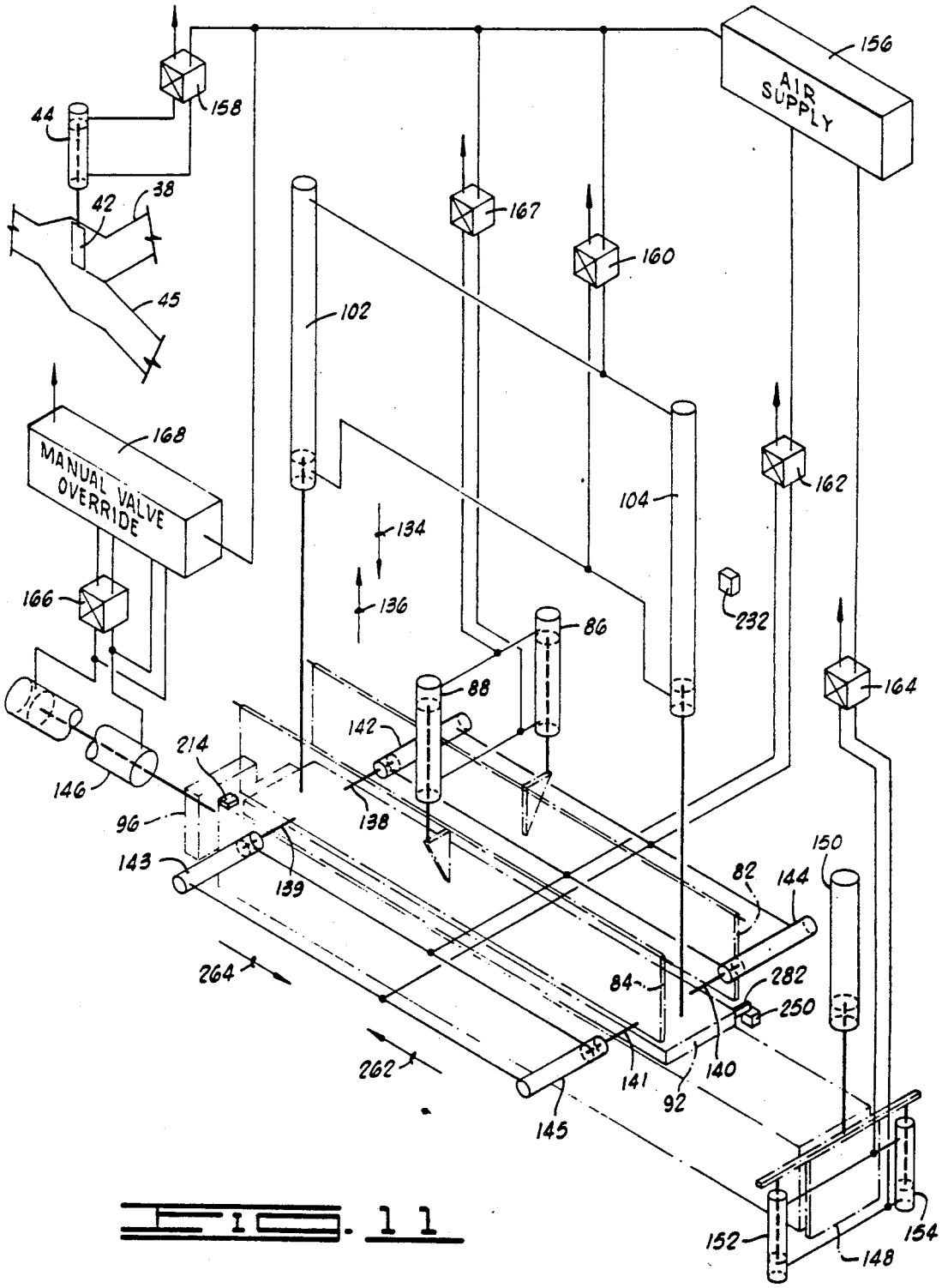
FIG. 11 is a schematic, diagrammatic view showing the hydraulic cylinders and associated values of the baler, which cooperate with the controls shown in FIGS. 8, 9 and 10 in controlling the operation of the baler.

In one preferred embodiment (shown in FIG. 11), one or more additional conduits may be connected to the inlet conduit 38. As shown in FIG. 11, the inlet door 42 is adapted to close the inlet conduit 38 in the closed position of the inlet door 42 and to close an additional conduit 45 in the opened position of the inlet door 42. By the same token, the inlet door 42 closes the additional conduit 45 in the opened position of the inlet door 42 and opens the additional conduit 45 in the closed position of the inlet door 42. In this emodiment with one additional conduit 45 connected to the inlet conduit 38, the inlet door 42 is operated so that when the inlet door 42 is closed, the material is diverted through the additional conduit 45 to another baler or to other process steps.

The pressing station 16 includes a generally rectangularly shaped pressing container 46. The pressing container 46 includes a first and a second side wall 48 and 50 (shown more clearly in FIGS. 1, 2, 4 and 5), an upper and a lower end wall 52 and 54 (shown more clearly in FIGS. 1, 2, 4 and 5), and a first and a second end wall 56 and 58 (shown more clearly in FIGS. 1 and 2). The walls 48, 50, 52, 54, 56 and 58 are interconnected to form a generally rectangularly shaped pressing container 46 and the walls 48, 50, 52, 54, 56 and 58 each include inner surfaces which substantially encompass and define a material receiving space 60 (shown in FIGS 4, 5 and 7) within a portion of the pressing container 46.

A generally rectangularly shaped receiving opening 62 (shown in FIGS. 4 and 5) is formed through the upper end wall 52 of the pressing container 46 and the receiving opening 62 extends generally between the first and the second side walls 48 and 50 and generally between the first and the second end walls 56 and 58 of the pressing container 46, thereby forming the generally rectangularly shaped receiving opening 62. More particularly, the receiving opening 62 is spaced a distance from the second end wall 58, for reasons to be described in greater detail below.

A generally rectangularly shaped discharge opening 64 (shown in FIG. 7) is formed through the second end wall 58 of the pressing container 46, the discharge opening 64 being generally rectangularly shaped in one form of the pressing container 46. A ram opening 66 (shown in FIG. 3) is formed through the first end wall 56 of the pressing container 46 and the ram opening 66 is generally rectangularly shaped in one form of the pressing container 46.

The receiving opening 62, the discharge opening 64 and the ram opening 66 each are in communication with the material receiving space 60 formed within the pressing container 46. The receiving opening 62 is positioned and adapted for receiving the material to be baled and passing such material into the material receiving space 60 and the discharge opening 64 is positioned and adapted for discharging the baled material from the material receiving space 60.

The pressing station 16 also includes pressing container supports 68 (shown more clearly in FIGS. 1, 6 and 7) and each support 68 has a portion connected to the pressing container 46 and a portion extending generally from the pressing container 46 terminating with an outermost end portion. The outermost end portion of each of the pressing container supports 68 is adapted to supportingly engage a floor or other support structure 70 for supporting the lower end wall 54 of the pressing container 46 a predetermined distance 72 (shown in FIG. 1) generally above such supporting surface 70.

The weighing station 14 includes a scale assembly 73 (shown more clearly in FIGS. 1 through 5) which, in general, is constructed and adapted to weigh objects supported thereon and to provide an output indication of the weight of such objects. Scale assemblies constructed to perform in a manner just described are commercially available and, in some instances, such scale assemblies provide an output indication via an indicator and a cooperating scale indicia, the indicator being movable and the position of the indicator with respect to the scale indicia providing the output indication of the weight. In the present application as shown more clearly in FIGS. 2, 3, 4, 5 and 8, a light source 75 and photoelectric or light sensing device 77 are positioned on such a commercially available scale assembly about a certain, predetermined weight indicia so a scale indicator 79 (shown in FIG. 1) interrupts the light communication to provide an electrical signal indicating that a certian predetermined weight has been supported on a plateform 81 of the scale assembly 73. It should be noted that some scale assemblies are of the balanced beam type where the tilt of the beam indicates the weight of material and, in this embodiment, the indicator 79 more particularly is a flag-type indicator attached to the beam and positioned so the flag indicator is pivoted by the beam to a position wherein the flag indicator is interposed between the light sensor 75 and the light sensing device 77 when the predetermined weight has been reached.

The weighing station 14 also includes a weighing container support assembly 74 (shown in FIGS. 1 through 5) having a portion which is connected to the weighing container 21. The weighing container support assembly 74 extends a distance from the weighing container 21 terminating with outermost end portions. In an assembled position, the outermost end portions of the weighing container support assembly 74 are supported on the platform 81 of the scale assembly 73 for supporting the weighing container 21 on the platform 81 the scale assembly 73. The scale assembly 73 is supported on the support structure 70 and the weighing container support assembly 74 is adapted to support the weighing container 21 on the platform 81 of the scale assembly 73 so the lower end wall 26 of the weighing container 21 is supported a predetermined distance 76 (shown in FIG. 1) generally above such supporting surface 70. The distance 72 extends from the supporting surface 70 to the lower end wall 54 of the pressing container 46, and the distance 76 extends generally between the supporting surface 70 and the lower end wall 26 of the weighing container 21.

In one preferred embodiment, the weighing container 21 is positioned and supported by the weighing container support assembly 74 generally above the pressing container 46 so that, in the assembled position, the lower end wall 26 of the weighing container 21 is positioned generally above the upper end wall 52 of the pressing container 46 and the lower end wall 26 of the weighing container 21 is spaced a distance 78 (shown in FIG. 1) generally from the upper end wall 52 of the pressing container 46. In this assembled position of the weighing container 21 and the pressing container 46, the discharge opening 36 in the weighing container 21 generally is aligned with the receiving opening 62 in the pressing container 46. The pressing container supports 68 are adapted to support the pressing container 46 a sufficient distance 72 above the support structure 70 so the scale assembly 73 and the cooperating portions of the weighing container support assembly 74 are disposed generally under the lower end wall 54 of the pressing container 46 with sufficient clearance so the pressing container 46 is not supported on the platform 81 of the scale assembly 73.

The width of the weighing container 21 is about the same as the width of the pressing container 46, and the first end wall 28 of the weighing container 21 substantially is aligned with the first end wall 56 of the pressing container 46 in the assembled position. The pressing container 46 has a length extending generally between the first and second end walls 56 and 58 which is longer than the length of the weighing container 21 extending generally between the first and second wall 28 and 30. Thus, a portion of the pressing container 46 is disposed generally below the weighing container 21 and a portion of the pressing container 46 extends a distance generally beyond the second end wall 30 of the weighing container 21 terminating with the second end wall 58 of the pressing container 46.

The baler 12 also includes a support door assembly 80 (shown more clearly in FIGS. 3, 4, and 5) which is interposed generally between the discharge opening 36 in the weighing container 21 and the receiving opening 62 in the pressing container 46. More particularly, the support door assembly 80 includes a first and a second support door 82 and 84, respectively. the first support door 82 includes an upper surface and a lower surface, and the second support door 84 includes an upper surface and a lower surface.

The first support door 82 generally is rectangularly shaped and extends generally between the first and the sencond end walls 28 and 30 of the weighing container 21 and gererally between the first and the second end walls 56 and 58 of the pressing container 46, and the first support door 82 also extends about halfway between the first side wall 20 and the second side wall 22 of the weighing container 21 and generally about halfway between the first side wall 48 and the second side wall 50 of the pressing container 46. More particularly, the first support door 82 is hingedly connected to the weighing container 21, generally near the lower end wall 26, so that the first support door 82 is movable from an opened position to a closed position and from a closed position to an opened position. The second support door 84 is hingedly connected to the weighing container 21, generally near the lower end wall 26, so that the second support door 84 also is movable from an opened position to a closed position and from a closed position to an opened position.

The first and the second support doors 82 and 84 each are connected to the weighing container 21 and generally positioned in the discharge opening 36 of the weighing container 21. In the closed position (shown in FIGS. 3 and 4), the first and the second support doors 82 and 84 each are disposed generally within and cooperate substantially to close the discharge opening 36 in the weighing container 21 with the first and the second support doors 82 and 84, respectively, cooperating to form a portion of the lower end wall 26 of the weighing container 21.

In the opened position of the first support door 82 (shown in FIG. 5), the first support door 82 is removed from the discharge opening 36 in the weighing container 21 and the first support door 82 extends a distance generally from the lower end wall 26 of the weighing container 21, generally adjacent the first side wall 20 of the weighing container 21, the first support door 82 extending generally between the lower end wall 26 of the weighing container 21 and the upper end wall 52 of the pressing container 46 in the opened position of the first support door 82 and the first support door 82 substantially extending the distance 78 generally between the lower end wall 26 of the weighing container 21 and the upper end wall 52 of the pressing container 46. In the opened position of the second support door 84 (shown in FIG. 5), the second support door 84 is removed from the discharged opening 36 in the weighing container 21 and the second support door 84 extends a distance generally from the lower end wall 26 of the weighing container 21, generally adjacent the second side wall 22 of the weighing container 21, the second support door 84 extending generally between the lower end wall 26 of the weighing container 21 and the upper end wall 52 of the pressing container 46 in the opened position of the second support door 84 and the second support door 84 substantially extending the distance 78 generally between the lower end wall 26 of the weighing container 21 and the upper end wall 52 of the pressing container 46. Thus, in the opened positions of the first and the second support doors 82 and 84, the support doors 82 and 84 are removed from the discharge opening 36 in the weighing container 21 and the support doors 82 and 84 each extend about the distance 78 generally between the weighing container 21 and the pressing container 46 substantially closing the gap between the lower end wall 26 of the weighing container 21 and the upper end wall 52 of the pressing container 46 and cooperating substantially to provide a path generally between the discharge opening 36 in the weighing container 21 and the receiving opening 62 in the pressing container 46.

A first support door cylinder 86 (shown more clearly in FIGS. 4 and 5) having a rod reciprocatingly disposed therein is connected to the first support door 82 for moving the support door 82 to the opened and closed positions. More particularly, the rod of the first support door cylinder 86 is connected to the first support door 82 via a linkage for hingedly moving the first support door 82 to the opened and closed positions.

A second support door cylinder 88 (shown more clearly in FIGS. 4 and 5) having a rod reciprocatingly disposed therein is connected to the second support door 84 for moving the second support door 84 to the opened and closed positions. More particularly, the rod of the second support door cylinder 88 is connected to the second support door 84 via a linkage for hingedly moving the second support door 84 to the opened and closed positions.

The baler 12 has a pressing assembly for engaging the material in the material receiving space 60 and applying a compressive force to such material to compress such material into a bale. The pressing assembly includes an upper pressing ram 92 (shown in FIGS. 1 through 5) having a pressing surface 94 formed thereon, and a horizontal pressing ram 96 (shown in FIGS. 1, 2, 3 and 7) having a pressing surface 98 formed thereon.

An upper pressing ram cylinder assembly is connected to the upper pressing ram 92 for moving the upper presssing ram 92 from a storage position to an engaging position and from an engaging position to a storage position. As the upper pressing ram 92 is moved to the engaging position, the pressing surface 94 is moved into engagement with the material to be baled in the material receiving space 60 in the pressing container 46 in a manner to be described in greater detail below.

The upper pressing ram cylinder assembly includes a first and a second cylinder 102 and 104 each having a rod which is reciprocatingly disposed therein. A portion of the weighing container support assembly 74 extends a distance in a generally upwardly direction above the upper end wall 24 of the pressing container 21. Each of the upper cylinder 102 and 104 is connected to portions of the weighing container support assembly 74.

The rod of the first upper cylinder 102 is connected to one end portion of the upper pressing ram 92 and the rod of the second upper cylinder 104 is connected to the opposite end portion of the upper pressing ram 92 so the upper cylinders 102 and 104 cooperate with the weighing container support assembly 74 to support the upper pressing ram 92 generally within or slightly above a rectangularly shaped ram opening 112 (shown in FIGS. 2, 4 and 5) formed through the upper end wall 24 of the weighing container 21 in a storage position of the upper pressing ram 92. In the storage position of the upper pressing ram 92, the upper pressing ram 92 substantially closes the ram opening 112 and the upper pressing ram 92 extends generally between the first and second end walls 28 and 30 and gererally between the first and second side walls 20 and 22.

The upper pressing ram 92 and the material receiving apace 32 in the pressing container 21 are shaped so the upper pressing ram 92 can pass through the material receiving space 32 as the upper pressing ram 92 is moved to the storage and engaging positions. Further, the upper pressing ram 92 and the receiving opening 62 formed through the upper end wall 52 of the pressing container 46 are shaped so that the upper closing ram 92 can pass through a portion of the receiving opening 62 and so that the upper pressing ram 92 is disposed within and substantially closes the receiving opening 62 in the engaging position of the upper pressing ram 92, the upper pressing ram 92 forming a portion of the upper end wall 52 of the pressing container 46 in the engaging position of the upper pressing ram 92.

An upper ram frame 114 (shown more clearly in FIG. 1) is connected to the upper surface of the upper pressing ram 92 and the upper ram frame 114 extends a distance generally upwardly from the upper surface of the upper pressing ram 92. A pulley-cable system comprising six pulleys 118, 120, 122, 124, 126 and 128 and two cables 130 and 132 is utilized to maintain the upper pressing ram 92 substantially in a horizontal plane as the upper pressing ram 92 is moved to the storage and engaging positions. The pulleys 118, 120, 122, 124, 126 and 128 each are journally supported on the weighing container support assembly 74.

One end of the cable 130 is connected to the upper ram frame 114 and the cable 130 extends from the upper ram frame 114 about the pulley 118, from the pulley 118 and about the pulley 122, from the pulley 122 and about the pulley 124, and from the pulley 124 to the upper ram frame 114 where the opposite end of the cable 130 is connected to the upper ram frame 114, the opposite ends of the cable 130 being connected to opposite end portions of the upper ram frame 114. One end of the cable 132 is connected to the upper ram frame 114 and the cable 132 extends from the upper ram frame 114 about the pulley 120, from the pulley 120 and about the pulley 128, from the pulley 128 and about the pulley 126 and from the pulley 126 to the upper ram frame 114 where the opposite end of the cable 132 is connected to the upper ram frame 114, the opposite ends of the cable 132 being connected to opposite end portions of the upper ram frame 114. The pulleys 118 and 120 are positioned above the upper end of the upper ram frame 114 and the remaining pulleys 112, 124, 126 and 128 each are positioned below the upper end of the upper ram frame 114.

As the upper pressing ram 92 is moved in a direction 134 (shown in FIG. 1) from a storage position toward an engaging position or in a direction 136 from an engaging position toward a storage position, the distances between the connections of the cables 130 and 132 to the upper ram frame 114 and the pulleys 118 and 120 increases and the distances between the movable connections of the cables 130 and 132 to the pulleys 122, 124, 126 and 128 and the upper ram frame decrease. In addition, the opposite ends of the cable 130 are connected to opposite end portions of the upper ram frame 114 and about the pulleys 118, 122 and 124 and the opposite ends of the cable 132 are connected to opposite end portions of the upper ram frame 114 and about the pulleys 120, 128 and 126 so that, as the upper pressing ram 92 is moved in the direction 134 or in the direction 136, the cable 130 places forces in opposite directions on the opposite ends of the upper ram frame 114 and the upper pressing ram 92 connected thereto and the cable 132 places forces in opposite directions on the opposite ends of the upper ram frame 114 and the upper pressing ram 92. Also, the cables 130 and 132 are connected to the upper ram frame 114 so that the forces applied via the cables 130 and 132 are in opposite directions at each end of the upper ram frame 114 and the upper pressing ram 92 connected thereto. Thus, the cables 130 and 132 are connected to the upper ram frame 114 so the cables 130 and 132 cooperate with the pulleys 118, 120, 122, 124, 126 and 128 substantially to maintain the upper pressing ram 92 disposed in a horizontal plane as the upper pressing ram 92 moves in the direction 134 toward the engaging position and as the upper pressing ram 114 moves in the direction 136 toward the storage position, thereby tending to prevent the upper pressing ram 92 from becoming tilted at an angle to horizontal in the material receiving space 32 and thus substantially preventing the upper pressing ram 92 from becoming jammed in the weighing container 21 as the upper pressing ram 92 moves to and from the storage and engaging positions.

As shown in FIG. 11, the baler 12 includes four lock pins 138, 139, 140 and 141, and each lock pin 138, 139, 140 and 141 is connected to one lock pin cylinder 142, 143, 144 or 145, respectively. Each lock pin cylinder 142, 143, 144 and 145 has a rod reciprocatingly disposed therein.

The lock pins 138 and 139 are disposed generally near the first end wall 56 of the pressing container 46 and generally near the upper end wall 52 so the lock pins 138 and 139 are movable from a storage position to a locking position wherein the lock pins 138 and 139 are disposed generally over a portion of the receiving opening 62 in the pressing container 46, the lock pins 138 and 139 being removed from the receiving opening 62 in the storage position of the lock pins 138 and 139. The lock pins 140 and 141 are disposed generally between the first and second end walls 56 and 58 of the pressing container 46 and generally near the upper end wall 52 so the lock pins 140 and 141 are movable from a storage position to a locking position wherein the lock pins 140 and 141 are disposed generally over a portion of the receiving opening 62 in the pressing container 46, the lock pins 140 and 141 being removed from the receiving opening 62 in the storage position of the lock pins 140 and 141. The lock pins 138 and 140 are disposed generally adjacent the first side wall 48 and the lock pins 139 and 141 are disposed generally adjacent the second side wall 50.

In the engaging position of the upper pressing ram 92, the upper pressing ram 92 is disposed generally within the receiving opening 62 and in a horizontal plane generally below the lock pins 138, 139, 140 and 141. In this engaging position of the upper pressing ram 92 and when the lock pins 138, 139, 140 and 141 are moved to the locking positions, the lock pins 138, 139, 140 and 141 are positioned above the upper pressing ram 92 for securing the upper pressing ram 92 in the engaging position and preventing movement of the upper pressing ram 92 in the direction 136.

As shown in FIG. 11, the pressing assembly also includes a horizontal pressing ram cylinder 146 having a rod reciprocatingly disposed therein. One end of the rod of the horizontal pressing ram cylinder 146 is connected to the horizontal pressing ram 96. The horizontal pressing ram cylinder 146 is adapted to move the horizontal pressing ram 96 from a storage position to an engaging position and from an engaging position to a storage position.

Figure 2:
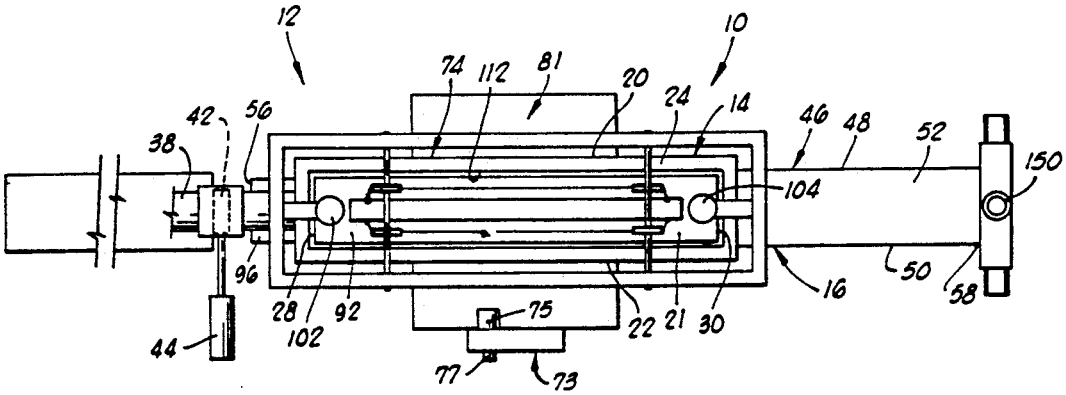
FIG. 2 is a top plan view of the baler of FIG. 1.

In the storage position, the horizontal pressing ram 96 is disposed within and substantially closes the ram opening 66 in the pressing container 46 (the horizontal pressing ram 92 being shown in FIGS. 1 and 2 slightly removed from the ram opening 66 for convenience). The horizontal pressing ram cylinder 146, the horizontal pressing ram 96 and the material receiving space 60 are positioned, sized and adapted so the horizontal pressing ram 96 moves through the material receiving space 60 as the horizontal pressing ram 96 is moved from the storage position to the engaging position wherein the pressing surface 98 of the horizontal pressing ram 96 compressingly engages the material to be baled in the material receiving space 60 within the pressing container 46 and so the horizontal pressing ram 96 moves through the material receiving space 60 in the pressing container 46 as the horizontal pressing ram 96 is moved from the engaging position to the storage position.

Figure 6:
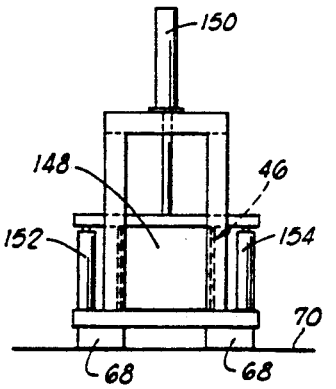
FIG. 6 is an end elevational view of the pressing station of the baler of the present invention showing a discharge door in the closed position.
Figure 7:
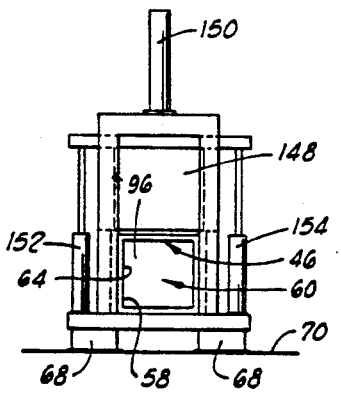
FIG. 7 is an end elevational view exactly like FIG. 6, but showing the discharge door in the opened position.

As shown more clearly in FIGS. 6 and 7, a generally rectangularly shaped discharge door 148 is movably positioned generally near the discharge opening 64 in the second end wall 58 of the pressing container 46 and the discharge door 148 is movable from a closed position (shown in FIG. 6) to an opened position (shown in FIG. 7) and from an opened position to a closed position. In the closed position, the discharge door 148 is disposed generally adjacent the discharge opening 64 in the pressing container 46 and, in the closed position, the discharge door 168 substantially encompasses and substantially closes the discharge opening 64. In the opened position, the discharge door 148 is removed from the discharge opening 64, thereby opening the discharge opening 64 for allowing the discharging of the baled material from the pressing container 46 through the discharge opening 64.

Three lift cylinders 150, 152 and 154 are connected to the discharge door 148 for moving the discharge door 148 to the opened and closed positions. Each of the lift cylinders 150, 152 and 154 includes a rod reciprocatingly disposed therein. More particularly, the rod of the lift cylinder 150 is connected to the upper end portion of the discharge door 148, the lift cylinder 150 pulling the discharge door 148 toward the opened position and pushing the discharge door 148 toward the closed position, during the operation of the baler 12. The rods of the lift cylinders 152 and 154 each are positioned to push the discharge door 148 toward the opened position and to pull the discharge door 148 toward the closed position.

As shown in FIG. 1, a pair of slots 155 are formed through a portion of the second side wall 50 of the pressing container 46, each of the slots 155 extending about the length of a bale of the material. Also, a pair of slots (not shown) are formed through the first side wall 48 of the pressing container 46 and these slots generally are aligned with the slots 155. The slots are used in tying the bale of material in a manner to be described further below.

As diagrammatically shown in FIG. 11, the various hydraulic cylinders of the baler 12 are connected to an air supply 156 through control valves which are operated to control the various hydraulic cylinders in accordance with the operation of the system 10 for producing bales of material. In one embodiment, most of the control valves are latching-type solenoid operated valves, although it should be noted that, in other applications, other forms of hydraulics and other types of control valves may be more desirable for various reasons.

The hydraulic cylinder 44 is operatively connected to the air supply 156 by way of a latching-type solenoid control valve 158. The control valve 158 is operable to connect the air supply 156 to the upper end of the hydraulic cylinder 44 for moving the inlet door 42 to one position for opening the conduit 38 and to connect the air supply 156 to the lower end of the hydraulic cylinder 44 for moving the inlet door 42 to one other position for closing the inlet conduit 38. The control valve 158 is operable to connect one end of the hydraulic cylinder 44, opposite the end connected to the air supply 156, to vent, as diagrammatically illustrated in FIG. 11.

The upper ends of the first and second upper cylinders 102 and 104 are connected together and the lower ends of the first and second upper cylinders 102 and 104 are connected together. The first and second upper cylinders 102 and 104 are connected to the air supply 156 by way of a latching-type solenoid control valve 160. The control valve 160 is operable to connect the upper ends of the first and second upper cylinders 102 and 104 to the air supply 156 for moving the upper pressing ram 92 in the downward direction 134 toward the engaging position and to connect the lower ends of the first and second upper cylinders 102 and 104 to the air supply 156 for moving the upper pressing ram 92 in the upward direction 136 to the storage position. In each instance, the ends of the first and second upper cylinders 102 and 104, which are not connected to the air supply 156 by way of the valve 160, are connected to vent, as diagrammatically illustrated in FIG. 11.

The upper ends of the lock pin cylinders 142, 143, 144 and 145 are connected together and the lower ends of the lock pin cylinders 142, 143, 144 and 145 are connected together. The lock pin cylinders 142, 143, 144 and 145 are connected to the air supply 156 by way of a latching-type solenoid control valve 162. The control valve 162 is operable to connect the upper end of the lock pin cylinders 142, 143, 144 and 145 to the air supply 156 for moving the lock pins 138, 139, 140 and 141 to the locking positions and to connect the lower ends of the lock pin cylinders 142, 143, 144 and 145 to the air supply 156 for moving the lock pins 138, 139, 140 and 141 to the storage positions. The control valve 162 is operable to connect the ends of the lock pin cylinders 142, 143, 144 and 145, opposite the ends connected to the air supply 156, to vent, as diagrammatically illustrated in FIG. 11.

The upper end of the lift cylinder 150 is connected to the lower ends of the lift cylinders 152 and 154, and the lower end of the lift cylinder 150 is connected to the upper ends of the lift cylinders 152 and 154. The lift cylinders 150, 152 and 154 are connected to the air supply 156 by way of a latching-type solenoid control valve 164. The control valve 164 is operable to connect the upper end of the lift cylinder 150 and the lower ends of the lift cylinders 152 and 154 to the air supply 156 for moving the discharge door 148 to the closed position, and to connect the lower end of the lift cylinder 150 and the upper ends of the lift cylinder 152 and 154 to the air supply 156 for moving the discharge door 148 to the opened position. The control valve 164 is operable to connect the ends of the lift cylinders 150, 152 and 154, opposite the ends connected to the air supply 156, to vent, as diagrammatically illustrated in FIG. 11.

The horizontal pressing ram cylinder 146 is connected to the air supply 156 by way of a latching-type solenoid control valve 166 and a manual valve override 168 (comprising valves and a hand lever) is connected about the control valve 166 for overriding the control function of the control valve 166 during one aspect of the operation to be described below. In a nonoperative condition of the manual valve override 168, the control valve 166 is operable to connect the upper end of the horizontal pressing ram cylinder 146 to the air supply 156 for causing the horizontal pressing ram 96 to be moved toward the engaging position, and to connect the lower end of the horizontal pressing ram cylinder 146 to the air supply 156 for causing the horizontal pressing ram 96 to be moved toward the storage position. The control valve 166 also operates to connect the end of the horizontal pressing ram cylinder 146, opposite the end which is connected to the air supply 156, to vent, as diagrammatically illustrated in FIG. 11. In an operative position, the manual valve override 168 functions to connect the air supply 156 to the upper end and to the lower end of the horizontal pressing ram cylinder 146 for controlling the positioning of the horizontal pressing ram cylinder 146 to move the horizontal pressing ram 96 from the storage position to the engaging position and from the engaging position to the storage position, thereby overriding the control function of the control valve 166. In addition, the control valve 166 preferably is a spring return type of manually operated control valve and the manual valve override 168 includes means for operating the control valve 166, such as a lever, for example.

The upper ends of the first and second support door cylinders 86 and 88 are connected together and the lower ends of the first and second support door cylinders 86 and 88 are connected together. The first and second support door cylinders 86 and 88 are connected to the air supply 156 by way of a latching-type solenoid control valve 167. The control valve 167 is operable to connect the upper ends of the first and the second support door cylinders 86 and 88 to the air supply 156 for closing the first and the second support doors 82 and 84, and to connect the lower ends of the first and the second support door cylinders 86 and 88 to the air supply 156 for opening the first and the second support doors 82 and 84. The control valve 167 is operable to connect the ends of the first and second support door cylinders 86 and 88, opposite the ends connected to the air supply 156, to vent, as diagrammatically illustrated in FIG. 11.

It should be noted that the "upper end" of a cylinder or hydraulic cylinder as that term is used herein refers to the end of the hydraulic cylinder or cylinder generally opposite the end having the rod reciprocatingly disposed therein, and the "lower end" of a cylinder or hydraulic cylinder as that term is used herein refers to the end of the hydraulic cylinder having the rod reciprocatingly disposed therein.

The weighing container 21 and the first and second upper cylinders 102 and 104, the upper ram frame 114 and the upper pressing ram 92 are supported on the platform 81 of the scale assembly 73 by way of the weighing container support assembly 74, the weight of the weighing container support assembly 74 also being supported on the platform 81 of the scale assembly 73. The pressing container 46 is supported above the platform 81 by way of the pressing container supports 68 and, thus, the pressing container 46 is not supported on the scale assembly 73. Since the material receiving space 32 is an integral part of the weighing container 21, the material passed into the weighing container 21 also is supported on the platform 81 of the scale assembly 73. Thus, the scale indicator 79 provides an output indication of the weight of the weighing container 21 and the other components connected thereto by way of the weighing container support assembly 74 and the weight of the material to be baled which is disposed in the material receiving space 32 in the weighing container 21.

The light source 75 and the light sensing device 77 are positioned with respect to the scale indicator 79 so that the scale indicator 79 is positioned between the light source 75 and the light sensing device 77 when the scale indicator 79 is moved to a position indicating the predetermined weight of material has been passed into the material receiving space 32. When a predetermined weight of material to be baled has been passed into the material receiving space 32, the scale indicator 79 is moved to a position wherein the scale indicator 79 is disposed generally between the light source 75 and the light sensing device 77, thereby interrupting light communication between the light source 75 and the light sensing device 77 and permitting the light sensing device 77 to provide an output indication indicating that the predetermined weight of material has been passed in the material receiving space 32 in the weighing container 21.

Figure 8:
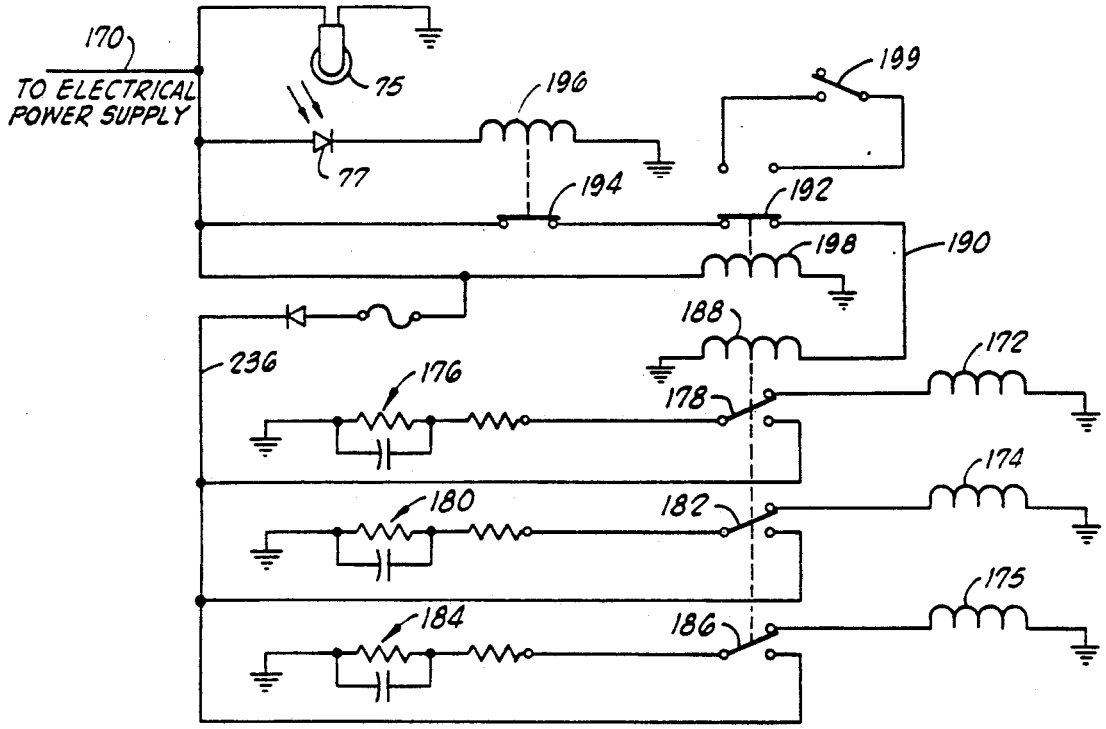
FIG. 8 is a schematic view showing a portion of the controls used for operating the baler of the present invention.

Shown in FIG. 8 is a portion of the controls of the system 10, the elements being shown in FIG. 8 in a condition when the predetermined weight of material has been passed into the material receiving space 32 in the weighing container 21. As shown in FIG. 8, the light sensing device 77 is a diode which is adapted to conduct when receiving light from the light source 75, the light source 75 and the light sensing device 77 being connected to an electrical power supply (not shown) by way of a conductor 170.

Shown in FIG. 8 is coil 172 which is operatively connected to the control valve 158 for controllingly operating the hydraulic cylinder 44, a coil 174 which is operatively connected to the control valve 167 for controllingly operating the first and second support door cylinders 86 and 88, and a coil 175 which is operatively connected to the control valve 160 for controllingly operating the first and second upper cylinders 102 and 104. The coil 172 is connected to a timing network 176 by way of a switch arm 178, the switch arm 178 having two positions: one position wherein the timing network 176 is connected to the coil 172, as shown in FIG. 8, and one other position wherein the timing network 176 is connected to the electrical power supply (not shown) by way of the conductor 170. The coil 174 is connected to a timing network 180 by way of a switch arm 182, the switch arm 182 having two positions: one position wherein the switch arm 182 connects the coil 174 to the timing metwork 180, as shown in FIG. 8, and one other position wherein the switch arm 182 connects the timing network 180 to the electrical power supply (not shown) by way of the conductor 170. The coil 175 is connected to a timing network 184 by way of a switch arm 186, the switch arm 186 having two positions: one position wherein the switch arm 186 connects the coil 175 to the timing network 184, as shown in FIG. 8, and one other position wherein the switch arm 186 connects the timing network 184 to the electrical power supply (not shown) by way of the conductor 170. The timing networks 176, 180 and 184 each comprise a resistor connected in parallel with a capacitor which are connected in series with another resistor.

A coil 188 is operatively connected to the switch arms 178, 182 and 186 and, when the coil 188 is energized, the coil 188 functions to move the switch arms 178, 182 and 186 to the position shown in FIG. 8 for connecting the respective coils 172, 174 and 175 to the respective timing networks 176, 180 and 184. The coil 188 is connected to the electrical power supply (not shown) by way of a conductor 190 which is connected to the conductor 170. A switch arm 192 and another switch arm 194 each are interposed in the conductor 190 with the switch arms 192 and 194 being in series. The switch arm 194 is operatively connected to a coil 196 and the switch arm 194 and the coil 196 operate so that the switch arm 194 is in the position shown in FIG. 8 establishing electrical continuity in the conductor 190 when the coil 196 is deenergized and such that the switch arm 194 is moved to a position interrupting electrical continuity in the conductor 190 when the coil 196 is energized. The coil 196 is connected in series with the light sensing device or diode 77 so that, when the diode 77 is conducting, the coil 196 is energized thereby moving the switch arm 194 to the opened position interrupting electrical continuity in the conductor 190. When the diode 77 is not conducting, the coil 196 is deenergized causing the switch arm 194 to be moved to the normally closed position establishing electrical continuity in the conductor 190.

A coil 198 is connected to the electrical power supply by way of the conductor 170 and the coil 198 is operatively connected to the switch arm 192. When the coil 198 is energized, the switch arm 192 is moved to the position shown in FIG. 8 establishing electrical continuity in the conductor 190. The switch arm 192 and the four contacts shown in FIG. 8 more particularly represent a time delay relay of the type commercially available from Dayton Electric Mfg. Co. of Chicago, Ill. Model 5X828B, for example, and, when a switch arm 199 is moved to the closed position, the switch arm 192 is moved to the opened position for a predetermined period of time (five seconds, for example) and then returned to the closed position (shown in FIG. 8) if the coil 198 is energized.

Figure 9:
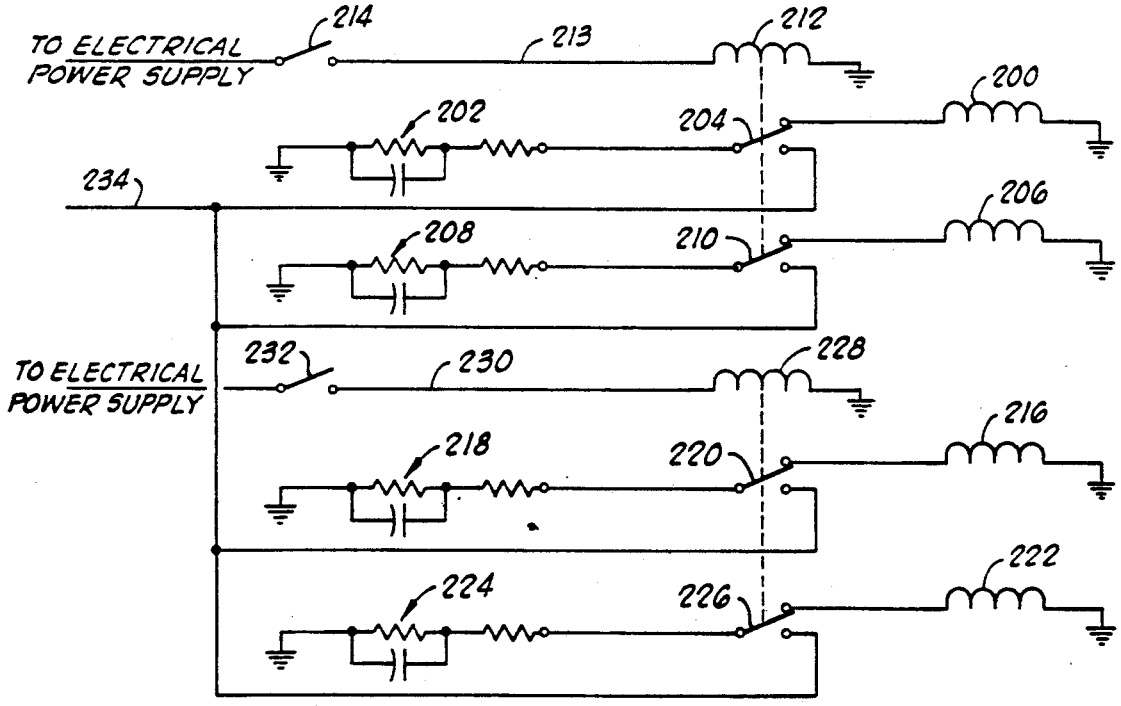
FIG. 9 is a schematic view similar to FIG. 8, but showing another portion of the controls used for operating the baler of the present invention.
Figure 1:
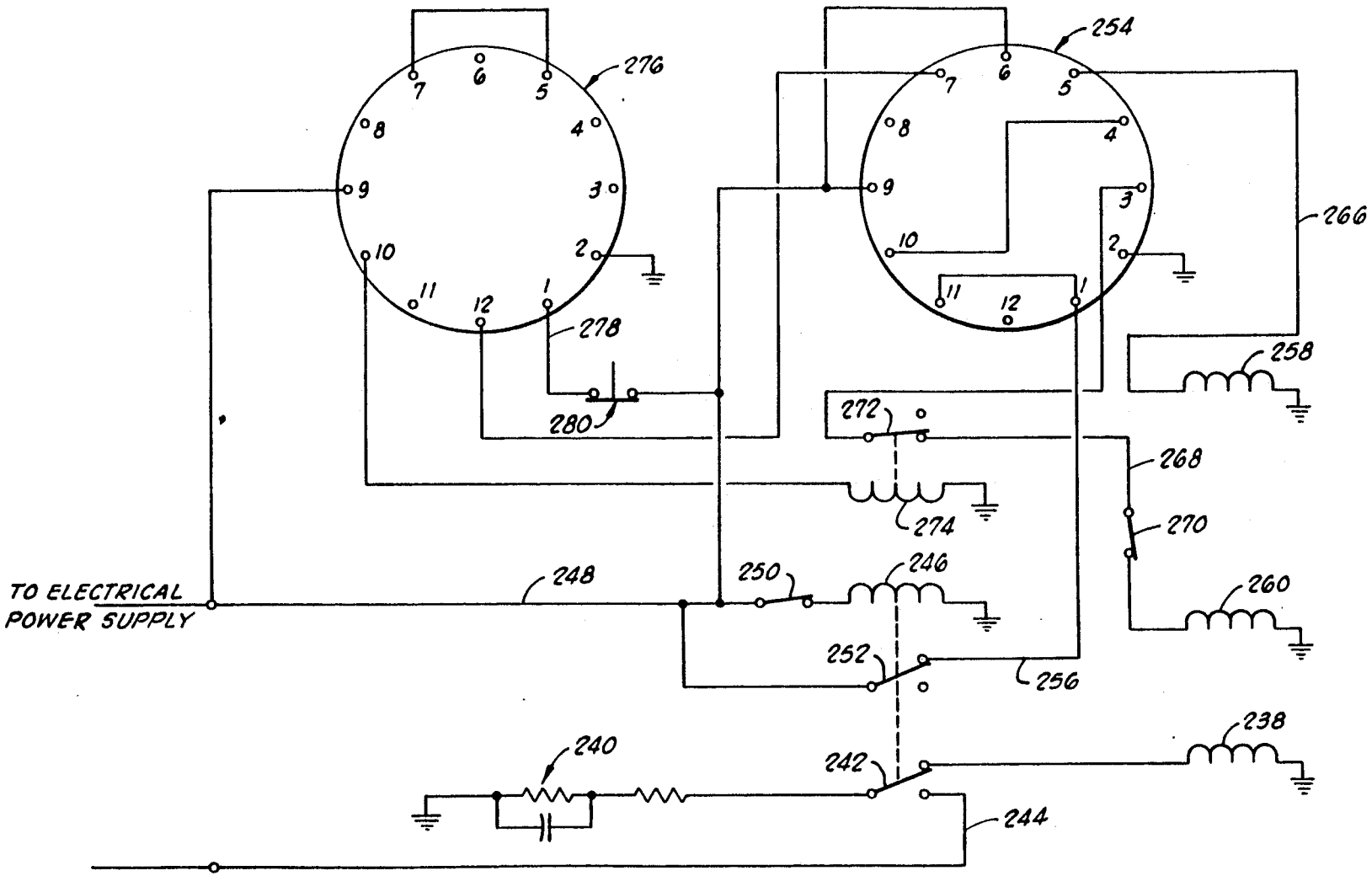

As shown in FIG. 9, the controls of the system 10 also include a coil 200 which is operatively connected to the control valve 162 for controllingly operating the lock pin cylinders 142, 143, 144 and 145. The coil 200 is connected to a timing network 202 (comprising a resistor and a capacitor connected in parallel with another resistor connected in series) by way of a switch arm 204. When the switch 204 is in the position shown in FIG. 9, the coil 200 is energized by the timing network 202 and, in the energized condition of the coil 200, the control valve 162 is positioned to connect the air supply 156 to the lower end portions of the lock pin cylinders 142, 143, 144 and 145 for moving the lock pins 138, 139, 140 and 141, respectively, to the storage or unlocked positions wherein the lock pins 138, 139, 140 and 141 each are removed from being positioned generally over the upper pressing ram 92.

The control valve 160 also is operatively connected to a coil 206 (shown in FIG. 9) and the coil 206 is connected to a timing network 208 (comprising a resistor and a capacitor connected in parallel and connected in series with another resistor) by way of a switch arm 210. The coil 210. The coil 206 is operatively connected to the control valve 160 such that, in the energized condition of the coil 206, the control valve 160 is conditioned to connect the air supply 156 to the lower ends of the first and the second upper cylinders 102 and 104 for moving the upper pressing ram 92 in the upward direction 136, the coil 206 being energized when the switch arm 210 is in the position shown in FIG. 9 connecting the coil 206 to the timing network 208. The switch arms 204 and 210 each are operatively connected to a coil 212 and, in the energized condition of the coil 212, the switch arm 204 is moved to the position shown in FIG. 9 connecting the coil 200 to the timing network 202 and the switch arm 210 is moved to the position shown in FIG. 9 connecting the coil 206 to the timing network 208. The coil 212 is interposed in a conductor 213 which is connected to an electrical power supply (not shown) by way of a switch 214 having an opened and a closed position. In the closed position of the switch 214, electrical continuity is established between the coil 212 and th electrical power supply (not shown) and, in the opened position of the switch 214, electrical continuity is interrupted between the coil 212 and the electrical power supply (not shown).

The contol valve 167 also is operatively connected to a coil 216 such that, when the coil 216 is energized, the control valve 167 is positioned to connect the air supply 156 to the upper ends of the first and second support door cylinders 86 and 88 for moving the first and second support doors 80 and 82 to the closed position. The coil 216 is connected to a timing network 218 (comprising a resistor and a capacitor connected in parallel and connected in series with another resistor) by way of a switch arm 220 such that the coil 216 is energized by the timing network 218 when the switch arm 220 is moved to the position shown in FIG. 9 connecting the coil 216 to the timing network 218.

The control valve 158 also is operatively connected to a coil 222 (shown in FIG. 9) such that, when the coil 222 is energized, the control valve 158 is positioned to connect the air supply 156 to the upper end of the hydraulic cylinder 44 for positioning the inlet door 42 in the the opened position establishing communication between the material source 40 and the material receiving space 32 in the weighing container 21 by way of the conduit 38. The coil 222 is connected to a timing network 224 (comprising a resistor and a capacitor connected in parallel and connected in series with another resistor) by way of a switch arm 226. When the switch arm 226 is in the position shown in FIG. 9 establishing electrical continuity between the coil 222 and the timing network 224, the coil 222 is energized by the timing network 224.

The switch arms 220 and 226 each are operatively connected to a coil 228m such that, when the coil 228 is energized, the switch arms 220 and 226 are each positioned in the positions shown in FIG. 9 respectively establishing electrical continuity between the coil 216 and the timing network 218 and between the coil 222 and the timing network 224. The coil 228 is connected to the electrical power supply (not shown) by way of a conductor 230 and a switch 232 is interposed in the conductor 230, the switch 232 having an opened and a closed position. In the closed position of the switch 232, electrical continuity is established between the electrical power supply (not shown) and the coil 228 thereby causing the switch arms 220 and 226 to be moved to the positions shown in FIG. 9 for respectively establishing electrical continuity between the coil 216 and the timing network 218 and between the coil 222 and the timing network 224. When the switch 232 is in the opened position (shown in FIG. 9) electrical continuity is interrupted between the electrical power supply (not shown) and the coil 228, thereby causing the switch arms 220 and 226 to be moved to the other positions shown in FIG. 9 for respectively interrupting electrical continuity between the coil 216 and the timing network 218 and between the coil 222 and the timing network 224.

The switch arms 204, 210, 220 and 226, as shown in FIG. 9, each have one position connecting the respective timing networks 202, 208, 218 and 224 to a conductor 234. The conductor 234 is connected to a conductor 236 (shown in FIG. 8) for connecting the timing networks 202, 208, 218 and 224 to the electrical power supply in the deenergized condition of the coils 212 and 228 when the switch arms 204, 210, 220 and 226 are positioned to establish electrical continuity between the respective timing networks 202, 208, 218 and 224 and the conductor 234.

The control valve 162 also is operatively connected to a coil 238 (shown in FIG. 10) such that, in the energized condition of the coil 238, the control valve 162 operates to connect the air supply 156 to the upper ends of the lock pin cylinders 142, 143, 144 and 145 for positioning the respective lock pins 138, 139, 140 and 141 in the locked position wherein each of the lock pins 138, 139, 140 and 141 is disposed generally over a portion of the upper pressing ram 92 for preventing movement of the upper pressing ram 92 in the upward direction 136. The coil 238 is connected to a timing network 240 (comprising a resistor and a capacitor connected in parallel and connected in series with another resistor) by way of a switch arm 242. When the switch arm 242 is in the position shown in FIG. 10 establishing electrical continuity between the coil 238 and the timing network 240, the coil 238 is energized by way of the timing network 240. The switch arm 242 also is connectable to a conductor 244 which is connected to the electrical power supply be way of the conductor 236 (shown in FIG. 8) for establishing electrical continuity between the electrical power supply and the timing network 240 when the switch arm 242 has been moved to a position contacting the conductor 244.

When the switch arms 178, 182 and 186 are positioned to connect the respective timing networks 176, 180 and 184 to the electrical power supply, the timing networks 176, 180 and 184, respectively, each are charged to a certain capacity determined by the values of the components of the timing networks 176, 180 and 184. When the switch arms 178, 182 and 186 are positioned as shown in FIG. 8 to connect the respective coils 172, 174 and 175 to the respective timing networks 176, 180 and 184, the timing networks 176, 180 and 184 each function to energize the respective coils 172, 174 and 175 for a predetermined amount of time determined by the charge stored in the respective timing networks 176, 180 and 184. The timing networks 202, 208, 218, 224 and 240 operate in the same manner to energize the respective coils connected thereto when so connected by way of the respective switch arms, the timing networks 202, 208, 218, 224 and 240 engaging the respective coils for predetermined periods of time.

The switch arm 242 is operatively connected to a coil 246 such that, when the coil 246 is energized, the switch arm 242 is moved to the position shown in FIG. 10 establishing electrical continuity between the coil 238 and the timing network 240 so the timing network 240 energizes the coil 238 for a predetermined period of time and such that, when the coil 246 is deenergized, the switch arm 242 is moved to the position establishing electrical continuity between the timing network 240 and the electrical power supply by way of the conductors 244 and 236, the conductor 244 being connected to the conductor 236. The coil 246 is connected to the electrical power supply (not shown) by way of a conductor 248 and a switch 250 is interposed in the conductor 248 generally between the electrical power supply (not shown) and the coil 246. In the closed position of the switch 250, as shown in FIG. 10, electrical continuity is established between the electrical power supply and the coil 246 thereby energizing the coil 246 and, in the opened position of the switch 250, electrical continuity is interrupted between the electrical power supply and the coil 246 thereby deenergizing the coil 246. The coil 246 also is operatively connected to a switch 252 and, in the energized condition of the coil 246, the switch 252 is moved to the position shown in FIG. 10 establishing electrical continuity between the electrical power supply and a timer 254 by way of a conductor 256, the switch 252 interrupting electrical continuity between the electrical power supply and the timer 254 in the deenergized condition of the coil 246.

The control valve 166 is operatively connected to a coil 258 (shown in FIG. 10) and to a coil 260 (shown in FIG. 10). In the energized condition of the coil 260, the control valve 166 operates to connect the air supply 156 to the lower end of the horizontal pressing ram cylinder 146 for moving the horizontal pressing ram 96 in a direction 262 generally from the engaging position toward the storage position. The coil 258 is operatively connected to the control valve 166 so that, in the energized condition of the coil 260, the control valve 166 operates to connect the air supply 156 to the upper end of the horizontal pressing ram cylinder 146 for moving the horizontal pressing ram 96 in a direction 264 from the storage position toward the engaging position.

The coil 258 is connected to the timer 254 by way of a conductor 266 and the coil 260 is connected to the timer 254 by way of a conductor 268. A switch 270 is interposed in the conductor 268 generally between the timer 254 and the coil 260 and, in the closed position of the switch 270, the switch 270 establishes electrical continuity between the timer 254 and the coil 260 (the switch arm 270 is operatively connected to the switch arm 214, shown in FIG. 9, so that, when the switch arm 214 is closed, the switch arm 270 is opened). A switch arm 272 also is interposed in the conductor 268 generally between the coil 260 and the timer 254 and the switch arm 272 is operatively connected to a coil 274. In the energized condition of the soil 274, the switch arm 272 is moved to the position shown in FIG. 10 establishing electrical continuity between timer 254 and the coil 260 and, in the deenergized condition of the coil 274, the switch arm 272 is moved to another position indicated in FIG. 10 interrupting electrical continuity between the coil 260 and the timer 254.

A counter 276 is connected to the timer 254 by way of a conductor 278 and a switch 280 is interposed in the conductor 278. The switch 280 establishes electrical continuity in the conductor 278 in the closed position of the switch 280, as shown in FIG. 10, and the switch 280 interrupts electrical continuity in the conductor 278 in the opened position of the switch 280.

Thus, the coils 172 and 222 each are operatively connected to the control valve 158, the coils 174 and 216 each are operatively connected to the control valve 167, the coils 175 and 206 each are operatively connected to the control valve 160, the coils 200 and 238 each are operatively connected to the control valve 162, and the coils 258 and 260 each are operatively connected to the control valve 166. The various timing networks function to energize the coils connected thereto for a predetermined, relatively short period of time for positioning the control valves in the positions described above and the latching-type solenoid valves are constructed to stay in one position even after the coils operatively connected thereto become deenergized, until the control valve is repositioned by energizing one of the coils operatively connected thereto.

In one embodiment, when the system 10 has utilized strands of material of the type generally referred to in the art as Easter grass, it has been found desirable to adjust or set the scale assembly 73 so that the scale indicator 79 interrupts the light communication between the light source 75 and the light sensing device when the weight of the material passed into the material receiving space 32 in the weighing container 21 equals about one-fourth of the total desired weight of the bale of material. In general, when this predetermined weight of material (about one-fourth the total desired weight of the bale of material) has been passed into the weighing container 21, the inlet door 42 is moved to the closed position (shown in FIG. 11) thereby directing the material through the conduit 45, and the first and second support doors 82 and 84 are opened so the material is passed from the weighing container 21 into the pressing container 46. Then, the upper pressing ram 92 is moved in the downward direction 134 to the engaging position wherein the upper pressing ram 92 is disposed within and closes the material receiving opening 62 in the pressing container 46, the upper pressing ram 92 compressingly engaging the material to be baled in the direction 134 as the upper pressing ram 92 is moved into the engaging position. After the upper pressing ram 92 has been positioned in the engaging position, the horizontal pressing ram 96 is moved in the direction 264 to the engaging position. As the horizontal pressing ram 96 is moving in the direction 264, the pressing surface 98 of the horizontal pressing ram 96 engages the material in the material receiving space 60 and moves the material in the direction 264 generally toward the second end wall 58 of the pressing container 21. The horizontal pressing ram cylinder 146 is sized so that the horizontal pressing ram 96 moves the material in the material receiving space 60 to a position wherein the horizontal pressing ram 96 compressingly engages the material to be baled in the direction 264 (generally perpendicular to the direction of compressing engagement imposed by the upper pressing ram 92) generally between the pressing surface 98 and the second end wall 58 (including portions of the first and second side walls 48 and 50 and portions of upper and lower end walls 52 and 54 generally near the second end wall 58) of the pressing container 21 (the discharge door 148 cooperating to form a portion of the second end wall 58 in the closed position of the discharge door 148). Since only one-fourth of the desired weight of material to form a bale initially is compressed in the pressing container 46, this process is repeated three more times until the total desired weight of material has been compressed into the bale of material. Before initiating the compressing of material to form the bale of material, two bale strings are disposed through the slots 155 and the corresponding slots (not shown) on the opposite side of the pressing container 21 so the bale strings are disposed generally adjacent and extend generally across the second end wall 58. After the bale of material has been compressed, the horizontal pressing ram 96 is held against the compressed bale of material while these bale strings are wrapped about the compressed bale of material, the bale strings then being tied to secure the compressed bale of material in the bale form. After the bale of material has been tied, the discharge door 148 then is moved to the opened position and the horizontal pressing ram 96 is moved in the direction 264 to discharge the tied bale from the material receiving space 60 through the discharge opening 64.

It is significant to note that the pressing container 21 has a sufficient length extending generally between the first and second end walls 56 and 58 so that the material to be baled is compressed in the pressing container 21 in the space between the material receiving opening 62 and the second end wall 58 and this space is enclosed by the portions of the first and second side walls 48 and 50, the upper and lower end walls 52 and 54, and the second end wall 58 (including the portions of the discharge door 148) closing the discharge opening 64. This space remains substantially enclosed while the bale of material is being formed. Thus, after the first sequence when one-fourth of the weight of material has been compressed in the pressing container 21 and the horizontal pressing ram 96 has been moved back to the storage position, the one-fourth portion of the bale of material disposed generally adjacent the second end wall 58 portion of the pressing container 21 will tend to decompress or move in the direction 262; however, the frictional forces imposed by the pressing container 21 wall portions in engagement with the compressed portion of the bale will tend to hold the portion of the bale in the compressed condition, although a portion of the bale will expand somewhat in the direction 262 when the horizontal pressing ram 96 is removed from engagement and moved back to the storage position.

Initially during the operation of the system 10, the first and second support doors 82 and 84 are in the closed position, the upper pressing ram 92 is in the storage position and the inlet door 42 has been moved to the opened position establishing communication between the material source 40 and the material receiving space 32 in the weighing container 21 by way of the conduit 38. Thus, in this initial operating position, the material to be baled is passed from the material source 40 into the material receiving space 32 in the weighing container 21. Also, in this initial operating condition, the lock pin cylinders 42, 43, 44 and 45 each are conditioned to move the respective lock pins 138, 139, 140 and 141 to the unlocked position, the horizontal pressing ram cylinder 146 is conditioned to move the horizontal pressing ram 96 to the storage position and the lift cylinders 150, 152 and 154 each are conditioned to move the discharge door 148 to the closed position.

Material continues to be passed from the material source 40 into the material receiving space 32 in the weighing container 21 until the weight of the material passed into the material receiving space 32 in the weighing container 21 reaches the predetermined weight (about one-fourth the total desired weight of the bale of material to be produced in the preferred embodiment). When the predetermined weight of material has been passed into the material receiving space 32 in the weighing container 21, the scale indicator 79 is moved to a position between the light source 75 and the light sensing device 77 thereby interrupting light communication between the light source 75 and the light sensing device 77 and causing the light sensing device 77 (the diode 77) to cease conducting, thereby deenergizing the coil 196 and moving the switch arm 194 to the normally closed position for establishing electrical continuity between the electrical power supply and the coil 188 for energizing the coil 188. The energizing of the coil 188 results in the switch arms 178, 182 and 186 each being moved to the positions shown in FIG. 8 for establishing electrical continuity between the coils 172, 174, 175 and respective timing networks 176, 180 and 184, thereby energizing the coils 172, 174 and 175 for predetermined period of time.

The energizing of the coil 172 causes the control valve 158 to connect the air supply 156 to the lower end of the hydraulic cylinder 44 for moving the inlet door 42 to the closed position (shown in FIG. 11) thereby interrupting communication between the material source 40 and the material receiving space 32 in the weighing container 21 and diverting the supply of material through the additional or auxiliary conduit 45. The energizing of the coil 174 causes the control valve 167 to connect the air supply 156 to the lower ends of the first and the second support door cylinders 86 and 88 for moving the first and the second support doors 82 and 84 to the opened position. The energizing of the coil 175 causes the control valve 160 to connect the air supply 156 to the upper ends of the first and the second upper cylinders 102 and 104 for moving the upper pressing ram 92 in the downward direction 134.

When the first and the second support doors 82 and 84 are moved to the opened position, communication is established between the discharge opening 36 in the weighing container 21 and the material receiving opening 62 in the pressing container 46 and the material disposed in the weighing container 21 is passed through the discharge opening 36, through the path established by the opened first and second support doors 82 and 84 and through the material receiving opening 62 and then to the material receiving space 60 in the pressing conatiner 46. The upper pressing ram 92 is moved via the first and second upper cylinders 102 and 104 in the downward direction 134 through the material receiving space 32 in the weighing container 21, through the discharge opening 36 in the weighing container 21 and into the material receiving opening 62 in the pressing container 46. As the pressing ram 92 is moved into the material receiving opening 62 in the pressing container 46, the upper pressing ram 92 compressingly engages the material which has been passed into the material receiving space 60 in the pressing container 46. When the upper pressing ram 92 has been positioned in the material receiving opening 62 in the pressing container 46, the upper pressing ram 92 encompasses and closes the material receiving opening 62.

The switch 250 (shown in FIG. 10) is positioned on the upper end wall 52 of the pressing container 46 generally near the material receiving opening 62 and a rod 282 (shown in FIG. 11) is connected to the upper pressing ram 92 and positioned so that the rod 282 engages and closes the switch 250 when the upper pressing ram 92 has been positioned in the enagaging position generally within the material receiving opening 62 in the pressing container 46. The closing of the switch 250 energizes the coil 246 which causes the switch arms 252 and 242 to be moved to the positions shown in FIG. 10 wherein the switch arm 252 establishes electrical communication between the timer 254 and the electrical power supply and wherein the switch arm 242 establishes electrical communication between the coil 238 and the timing network 240 thereby energizing the coil 238 for a predetermined period of time. The energizing of the coil 238 causes the control valve 162 to connect the air supply 156 to the upper ends of the lock pin cylinders 142, 143, 144 and 145 thereby causing the respective lock pins 138, 139, 140 and 141 to be moved to the locking position wherein the lock pins 138, 139, 140 and 141 each are disposed generally over and above a portion of the upper surface of the upper pressing ram 92, the locking pins 138, 139, 140 and 141 cooperating to prevent movement of the upper pressing ram 92 in the upward direction 136 in the locking position, thereby securing the upper pressing ram 92 in the material receiving opening 62 in the pressing container 46.

When the switch arm 252 is moved to the position shown in FIG. 10, the electrical power supply (not shown) is connected to pin one of the timer 254 which causes the timer 254 to initiate the timing cycle preset in the timer 254, and, for this preset period of time, the timer 254 connects the electrical power supply to pin five of the timer 254 thereby connecting the coil 258 to the electrical power supply by way of the conductor 266 thereby energizing the coil 258. The energizing of the coil 258 causes the control valve 166 to connect the air supply 156 to the upper end of the horizontal pressing ram cylinder 146 thereby causing the horizontal pressing ram 96 to be moved in the direction 264. As the horizontal pressing ram 96 is moved in the direction 264, the pressing surface 98 of the horizontal pressing ram 96 engages the material disposed in the material receiving space 60 in the pressing container 46 and moves the material in the direction 264 generally toward the second end wall 58 of the pressing container 46. The horizontal pressing ram 96 moves the material in the material receiving space 60 in the pressing container 46 to a position wherein the material is disposed generally adjacent the second end wall 58 and the discharge door 148, the pressing surface 98 of the horizontal pressing ram 96 compressingly engaging the material within the confined space generally between the pressing surface 98 of the horizontal pressing ram 96 and the portions of the pressing container 46 generally near the second end wall 58 including portions of the discharge door 148 which close the discharge opening 64.

The timer 254 is set to determine the specific length of time during which the pressing surface 98 of the horizontal pressing ram 96 compressingly engages the material to be baled (preferably about 10 to about 15 seconds when bailing Easter grass in accordance with the present invention), and the timer 254 functions to keep the coil 258 energized during this preset period of time. In addition, the timer 254 functions to provide a pulse from pin seven of the timer 254 to the counter 276 indicating the completion of one cycle of the system 10. As mentioned before, about one-forth of the total weight of a bale of material is compressed during each cycle of the system 10 so, in this embodiment, the counter 276 is set to count four cycles with a count being subtracted in the counter 276 each time the counter 276 receives a pulse or signal from pin seven of the timer 254 indicating the completion of one cycle of the system 10.

When the specific length of time determined by the timer 254 has lapsed, the timer 254 deenergizes the coil 258 and the timer then functions to connect the electrical power supply to pin three thereby energizing the coil 260. The energizing of the coil 260 causes the control valve 166 to connect the air supply 156 to the lower end of the horizontal pressing ram cylinder 146 thereby causing the horizontal pressing ram 96 to be moved from the engaging position in the direction 262, the horizontal pressing ram 96 being moved in the direction 262 until the horizontal pressing ram 96 reaches the storage position.

As shown in FIG. 11, the switch 214 (shown in FIG. 9) is disposed on the pressing container 46 and positioned such that a portion of the horizontal pressing ram 96 engages a portion of the switch 214 when the pressing ram 96 has been moved from the engaging position in the direction 262 to the storage position for closing the switch 214. The closing of the switch 214 connects the coil 212 to the electrical power supply, thereby energizing the coil 212 and causing the switch arms 204 and 210 to be moved to the position shown in FIG. 9 for energizing the coils 200 and 206 by way of the respective timing networks 202 and 208. The energizing of the coil 200 causes the control valve 162 to connect the air supply 156 to the lower ends of the lock pin cylinders 142, 143, 144 and 145 so the lock pin cylinders 142, 143, 144 and 145 cause the respective lock pins 138, 139, 140 and 141 to be moved to the storage position or, in other words, removed from the locked or locking position. The energizing of the coil 206 causes the control valve 160 to connect the air supply 156 to the lower ends of the first and the second upper cylinders 102 and 104 thereby causing the upper pressing ram 92 to be moved in the upward direction 136 to the storage position.

The switch 232 (shown in FIG. 9) is disposed on the weighing container 21 generally near the ram opening 112 and positioned so that, when the upper pressing ram 92 reaches the storage position disposed generally within the ram opening 112, a portion of the upper pressing ram 92 engages and closes the switch 232. The closing of the switch 232 connects the coil 228 to the electrical power supply, thereby energizing the coil and causing the switch arms 220 and 226 to be moved to the positions shown in FIG. 9 connecting the coils 216 and 222 to the respective timing networks 218 and 224. The connecting of the coil 216 to the timing network 218 energizes the coil 216 and the energizing of the coil 216 causes the control valve 167 to connect the air supply to the upper ends of the first and second support door cylinders 86 and 88 for moving the first and second support doors 82 and 84 to the closed position. The connection of the coil 222 to the timing network 224 results in the coil 222 being energized and the energizing of the coil 222 causes the control valve 158 to connect the air supply 156 to the upper end of the hydraulic cylinder 154 for moving the inlet door 42 to the opened position reestablishing communication between the material source 40 and the material receiving space 32 in the weighing container 21 by way of the conduit 38.

Preferably, the switch arm 232 is operatively connected to the switch arm 199 so that, when the switch arm 232 is moved to the closed position indicating the upper pressing ram 92 has been returned to the storage position, the switch arm 199 also is closed causing the switch arm 192 to be moved to the contacts connected to the switch arm 199 thereby interrupting electrical communication in the conductor 190 and the switch arm 199 remains in this position for the predetermined time delay (about five seconds in one embodiment when utilizing the system 10 for bailing Easter grass). At the end of this predetermined time delay, the switch arm 192 again is moved to the position shown in FIG. 8 establishing electrical communication in the conductor 190. When the upper pressing ram 92 is moved to the storage position and the support doors 82 and 84 are closed, the weighing container 21 may vibrate and such vibration may cause the scale assembly 73 to provide an intermittent false indication, so the momentary disconnect accomplished by moving the switch arm 199 to a position preventing the coil 188 from being energized allows a small period of time for the structure of the baler 12 to stabilize before initiating the next weighing and compression cycle.

This process is repeated a total of four times with one-forth of the total desired bale weight of material being compressed each time, and a count is subtracted from the counter 276 with each weighing and compression cycle. After the fourth compression cycle and with the horizontal pressing ram 92 in the engaging position, the counter 276 goes to zero and pin ten on the counter 276 goes "hot" or, in other words, the counter 276 functions to connect the electrical power supply to energize the coil 274 to open the normally closed switch arm 272 so the horizontal pressing ram 92 cannot be moved to the storage position. In this condition, both of the coils 258 and 260 are deenergized thereby causing the control valve 166 to be positioned in a neutral position so the horizontal pressing ram 92 is in the engaging position but not compressingly engaging the bale of material.

In this condition with the control valve 166 in the neutral position and with the horizontal pressing ram 96 in the extended position, the operator manually ties the bale strings about the bale of material in the pressing container 46.

The manual valve override 168 is operatively connected to the control valve 166 for controllingly operating the control valve 166, and the manual valve override 168 includes a hand-operated lever for connecting the air supply 156 to the horizontal pressing ram cylinder 146 for controlling the horizontal pressing ram 96 overriding the control of the control valve 166.

After the bale of material has been tied, the operator positions the manual valve override 168 for operating the control valve 164 to connect the air supply 156 to the lower end of the lift cylinder 150 and to the upper ends of the lift cylinders 152 and 154, thereby opening the discharge door 148. The operator then positions the manual valve override 168 for supplying additional air to the upper end of the horizontal pressing ram cylinder 146, thereby causing the horizontal pressing ram 96 to be moved in the direction 264 for pushing the tied bale of material through the discharge opening 64 and discharging the tied bale of material from the pressing container 46.

After the tied bale of material has been discharged from the pressing container 46, the operator positions the manual valve override 168 for returning the horizontal pressing ram 96 to the storage position, connecting the air supply 156 to the lift cylinders 150, 152 and 154 for closing the discharge door 148 and returning control of the horizontal pressing ram cylinder 166 to the control valve 166.

After the bale of material has been discharged from the pressing container 46 and the discharge door 148 has been closed and the horizontal pressing ram 96 has been moved to the storage position, the operator then manually presses the reset button or switch arm 280 to move the switch arm 280 to the closed position shown in FIG. 10 which causes the electrical power supply to be connected to pin one of the counter 276 to reset the counter 276 and pin ten of the counter 276 goes to zero thereby deenergizing the coil 247 and causing the switch arm 272 to be returned to the normally closed position.

As mentioned before, it has been found desirable to compress about one-forth of the total desired bale weight of material during each cycle. Also, it has been found desirable to set the timer 254 and counter 276 so that the horizontal pressing ram 96 compressingly engages the material for a period of time of about ten to about fifteen seconds when compressing strands of material of the type generally referred to in the art as Easter grass. The timer 254 shown in FIG. 10 is a commercially available timer available from Eagle Signal Division of Gulf Western Mfg. Co. of Davenport, Iowa, Model HD51AG. The counter 276 shown in FIG. 10 is a commercially available counter available from Eagle Signal Division of Gulf Western Mfg. Co. of Davenport, Iowa, Model HZ171A6.

In one embodiment, the pressing container 46 is about ten feet long with the inner dimensions of the material receiving space being about a little over twelve incles by twelve inches with the horizontal pressing ram 96 having a pressing surface 96 which is twelve inches by twelve inches. The length of the weighing container 21 is about six feet and this leaves at least four feet of length between the material receiving opening 62 and the second end wall 58 or, in other words, at least four feet of enclosed space within which to compress the material in the horizontal direction and, in this embodiment, the length of the bale of material to be produced is less than the four feet within which the bale of material is compressed in the pressing container 46, a typical bale of material produced via this embodiment having dimensions of thirteen inches by thirteen inches by thirty inches when removed from the pressing container 46. In this embodiment, the horizontal pressing ram cylinder 146 was adapted to apply a force of about five thousand pounds during the compressing mode of operation and the length of the stroke varied between about eight feet and about ten feet. In this embodiment, the horizontal pressing ram cylinder 146 is adapted to cause the horizontal pressing ram 96 to apply about 5,000 pounds of force during the compression cycle.

Three sample bales of Easter grass were produced utilizing the system 10 of the present invention. In this example, the bales generally were about 12 inches by 12 inches as produced in the baler and the bales in general expanded to about 14 inches by 15 inches after being removed from the baler. These sample bales had the following characteristics:

| | Bale Dimensions (Inches) | Bale Volume (Cubic Feet) | Bale Weight (Pounds) | Bale Density (Pounds Per Cubic Foot) |
|---|---|---|---|---|
| 1. | 14 × 15 × 30 | 3.6 | 55 | 13.9 |
| 2. | 14 × 14 × 31 | 3.5 | 50 | 14.3 |
| 3. | 14 × 15 × 30 | 3.6 | 50 | 13.9 |

By way of camparison, three sample bales of Easter grass produced in a prior system were about 12 inches by 12 inches as produced in the prior baler and the prior bales expanded to about 14 inches by 15 inches after being removed from the baler. These sample prior bales had the following characteristics:

| | Bale Dimensions (Inches) | Bale Volume (Cubic Feet) | Bale Weight (Pounds) | Bale Density (Pounds Per Cubic Foot) |
|---|---|---|---|---|
| 1. | 21 × 15 × 34 | 6.2 | 55 | 8.8 |
| 2. | 20 × 15 × 32 | 5.6 | 50 | 8.9 |
| 3. | 21 × 13 × 31 | 4.9 | 50 | 10.2 |

As may be obvserved from the above sample bales, the bales of Easter grass produced utilizing the system of the present invention each had a density of about 14 pounds per cubic foot as compared with the prior bales which had a density of between 8.8 and 10.2 pounds per cubic foot. Thus, virtually, the weight of Easter grass (about 50 pounds) was contained in a bale of Easter grass produced in accordance with the present invention while the dimensions of the bale of Easter grass were substantially reduced as compared to the dimension of prior bales of Easter grass.

Also, it should be noted that the density of the bale of material will vary somewhat depending upon the exact nature of the material being baled and the term "about 14 pounds per cubic foot" as used herein refers to the density of a bale of Easter grass and the word "about" is utilized to recognize variance which might result from variations in the process in the type of material being baled.

Utilizing the system 10 of the present invention, the bale of Easter grass not only has a density of at least about 14 pounds per cubic foot, but, also, a substantial portion of the baled Easter grass is unmatted. Although the exact unmatted portion of the bale of Easter grass is not subject to any known precise objective test, from observation and visual inspection, the bale of Easter grass produced in accordance with the present invention has an unmatted portion in a range from about 80 percent by weight to about 100 percent by weight of the total weight of the baled Easter grass.

Further, in the one embodiment of the bale 12 referred to before, it should be noted that knives are not utilized to cut the baled material as part of the baling operation for any reason, since it has been discovered that balers having and utilizing such knives promote matting of the material. Also, the material is baled in accordance with the system 10 of the present invention utilizing a minimum number of strokes of the upper pressing ram 92 (one stroke) and the horizontal pressing ram 96 (four strokes) and it is believed that the utilization of a minimum number of strokes contributes to the result of having a substantial portion of the bale of material in an unmatted condition.

The bale of material produced utilizing the system 10 of the present invention can have varying dimensions and thus varying total weights. However, to distinguish a bale of material from other forms of material containers, the bale of material contemplated via the present invention has a total weight of at least five pounds.

The bale of material produced utilizing the system 10 of the present invention is expandable when the means (strings or bands or the like) for securing the material in the bale form are removed and this expansion functions to initiate the separation of the baled material, thereby cooperating with the "unmatted" feature to assist in separating the baled material.

It should be noted that the vertical compression imposed by the upper pressing ram 92 is not a full or maximum compression stroke since the downward movement of the upper pressing ram 92 is limited to positioning the upper pressing ram 92 in the material receiving opening 62 in the pressing container 46.

Changes may be made in the various elements and assemblies and in the steps or sequence of steps without departing from the spirit and the scope of the invention as defined in the following claims.

What is claimed is:

1. An apparatus for baling strands of material comprising:

a pressing container having a first end wall and a second end wall and a material receiving space formed in a portion thereof extending generally between the first and the second end walls, the strands of material to be baled being disposed in the material receiving space, and a portion of the pressing container generally near the second end wall being substantially enclosed, the pressing container having an upper end wall and a lower end wall with a material receiving opening being formed through a portion of the upper end wall of the pressing container;

a horiaontal pressing ram having a pressing surface formed thereon, the horizontal pressing ram being moved through at least a portion of the material receiving space in the pressing container;

means connected to the horizontal ram for moving the horizontal pressing ram from a storage position to an engaging position, the pressing surface of the horizontal pressing ram compressingly engaging the strands of material within the substantially enclosed portion of the pressing container for forming the strands of material into a bale of material;

a weighing container having a material receiving space formed in a portion thereof, the strands of material to be baled being received within the material receiving space of the weighing container, a receiving opening formed through a portion of the weighing container in communication with the material receiving space in the weighing container and a discharge opening being formed through a portion of the weighing container in communication with the material receiving space in the weighing container, the strands of material to be baled being passed through the receiving opening in the weighing container and into the material receiving space in the weighing container and the strands of material to be baled being passed from the material receiving space in the weighing container through the discharge opening in the weighing container for passing the strands of material to be baled from the weighing container, the weighing container having an upper end wall and a lower end wall with the discharge opening being formed through the lower end wall of the weighing container;

a scale assembly supporting the weighing container and providing an output indication indicating that a predetermined weight of strands of material is disposed in the material receiving space in the weighing container;

means for supporting the weighing container on the scale assembly and for supporting the weighing container above the pressing container with the lower end wall of the weighing container being disposed above and spaced a distance from the upper end wall of the pressing container, the discharge opening in the weighing container being aligned with the material receiving opening in the pressing container, the strands of material to be baled being passed from the material receiving space in the weighing container through the discharge opening in the weighing container and through the material receiving opening in the pressing container into the material receiving space within the pressing container;

a support door assembly having an opened position and a closed position, the support door assembly substantially closing the discharge opening in the weighing container in the closed position and the support door assembly being removed from the discharge opening in the weighing container in the opened position, the strands of material to be baled being passed from the receiving space in the weighing container through the discharge opening in the weighing container in the opened position of the support door assembly;

means for moving the support door assembly from the opened position to the closed position and from the closed position to the opened position;

an upper pressing ram having a pressing surface formed on a portion thereof; and means for moving the upper pressing ram from a storage position to an engaging position, the pressing surface of the upper pressing ram being moved into compressing engagement with the strands of material in the material receiving space in the pressing container in the engaging position of the upper pressing ram; and wherein the weighing container is further defined to include a ram opening formed through a portion of the upper end wall of the weighing container; and wherein the upper pressing ram is defined further as being supported within a portion of the ram opening in the weighing container and substantially closing the ram opening in the weighing container in the storage position of the upper pressing ram; and wherein the means for moving the upper pressing ram to the storage position into the engaging position is defined further as moving the upper pressing ram to the storage position wherein the upper pressing ram is disposed within and substantially closes the ram opening in the weighing container in the storage position of the upper pressing ram and as moving the upper pressing ram from the ram opening through a portion of the material receiving space in the weighing container through the discharge opening in the weighing container and into the material receiving opening in the pressing container as the upper pressing ram is moved from the storage to the engaging position, the upper pressing ram being disposed within and substantially closing the material receiving opening in the pressing container in the engaging position of the upper pressing ram.

2. The apparatus of claim 1 wherein the pressing container is defined further to include a discharge opening formed through the second end wall, a bale of material being discharged from the material receiving space through the discharge opening; and wherein the apparatus is defined further to include:

a discharge door moveably connected to the second end wall of the pressing container, the discharge door being moved from an opened position to a closed position, the discharge door substantially enclosing the discharge opening in the pressing container in the closed position of the discharge door and cooperating to form a portion of the second end wall of the container and the discharge door being substantially removed from the discharge opening in the opened position of the discharge door; and means for moving the discharge door from the opened to the closed position and for moving the discharge door from the closed to the opened position.

3. The apparatus of claim 2 wherein the means for moving the horizontal pressing ram is defined further as being for moving the horizontal pressing ram into engagement with the bale of material and for moving the horizontal pressing ram to move the bale of material through the discharge opening in the pressing container in the opened position of the discharge door for discharging the bale of material from the material receiving space in the pressing container.

4. The apparatus of claim 1 wherein the material receiving opening is disposed generally near the first end wall of the pressing container and spaced a sufficient distance from the second end wall of the container so the portion of the pressing container extending generally between the material receiving opening and the second end wall forms the substantially enclosed portion of the container, the distance being sufficient to accommodate a bale of material generally within the substantially enclosed portion of the pressing container.

5. The apparatus of claim 1 wherein the support door assembly is defined further to include:

a first support door having a portion hingedly connected to a portion of the weighing container and having an opened position and a closed position, the first support door substantially enclosing a portion of the discharge opening in the weighing container in the closed position of the first support door and the first support door being removed from the discharge opening in the weighing container in the opened position of the first support door;

a second support door having a portion hingedly connected to the weighing container and having an opened position and a closed position, the second support door encompassing and closing a portion of the discharge opening in the closed position of the second support door and the second support door being removed from the discharge opening in the opened position of the second support door, the first and the second support doors cooperating to substantially encompass and close the discharge opening in the weighing container in the closed positions of the first and second support doors; and wherein the means for moving the support door assembly to the opened and the closed positions is defined further as having portions connected to the first and second support doors for moving the first and second support doors from the opened position to the closed position and for moving the first and second support doors from the closed position to the opened position.

6. The apparatus of claim 5 wherein the first support door is defined further as extending a distance from the lower end wall of the weighing container generally toward the upper end wall of the pressing container in the opened position of the first support door; and wherein the second support door is defined further as extending a distance generally between the lower end wall of the weighing container toward the upper end wall of the pressing container in the opened position, the first and the second support doors cooperating to provide a path for the strands of material to be passed from the weighing container into the pressing container in the opened position of the first and the second support doors.

7. The apparatus of claim 1 defined further to include:

at least one lock pin; and means for positioning the lock pins in a locking position after the upper pressing ram has been moved to the engaging position and in a storage position, the lock pins being disposed near the upper pressing ram for preventing movement of the upper pressing ram from the engaging position toward the storage position; and wherein the means for moving the horizontal pressing ram is defined further as moving the horizontal pressing ram to the engaging position after the upper pressing ram has been positioned in the engaging position.

8. The apparatus of claim 7 wherein the means for moving the upper pressing ram is defined further as moving the upper pressing ram from the storage position to the engaging position in response to an output indication of the scale assembly indicating a predetermined weight of strands of material has been disposed in the material receiving space in the weighing container; and wherein the means for moving the support door assembly is defined further as moving the support door assembly from the closed position to the opened position in response to the output indication of the scale assembly indicating a predetermined weight of strands of material has been disposed in the material receiving space in the pressing container; and wherein the means for moving the horizontal pressing ram is defined further as moving the horizontal pressing ram from the storage position to the engaging position in response to the upper pressing ram being positioned in the engaging position.

9. The apparatus of claim 8 wherein the means for moving the horizontal pressing ram is defined further as maintaining the horizontal pressing ram in the engaging position for a predetermined period of time and as moving the horizontal pressing ram from the engaging position to the storage position after the lapse of the predetermined period of time.

10. The apparatus of claim 9 defined further to include:

means for passing strands of material into the material receiving space in the weighing container; and means for preventing the passing of strands of material into the material receiving space of the weighing container in response to an output indication indicating a predetermined weight of strands of material has been disposed in the material receiving space in the weighing container.

11. The apparatus of claim 1 defined further to include:

means for supporting the pressing container spaced a distance above a portion of the scale assembly so the pressing container is not supported on the scale assembly.

* * * * *

UNITED STATES PATENT AND TRADEMARK OFFICE
CERTIFICATE OF CORRECTION

PATENT NO. : 5,111,741

DATED : May 12, 1992

INVENTOR(S) : Donald E. Weder, et al.

It is certified that error appears in the above-identified patent and that said Letters Patent is hereby corrected as shown below:

Column 4, line 61, delete the word "certian" and substitute therefore the word --certain--.

Column 6, line 1, delete the word "the" and substitute therefore the word --The--.

Column 8, line 8, delete the word "closing" and substitute therefore the word --pressing--.

Column 13, line 37, add the word --a-- after the word, is.

Column 13, line 55, delete the word "metwork" and substitute therefore the word --network--.

Column 15, line 39, delete the second word "the".

Column 15, line 51, delete the numeral "228m" and substitute therefore the numeral --228-.

UNITED STATES PATENT AND TRADEMARK OFFICE

CERTIFICATE OF CORRECTION

PATENT NO. : 5,111,741

DATED : May 12, 1992

INVENTOR(S) : Donald E. Weder, et al.

It is certified that error appears in the above-identified patent and that said Letters Patent is hereby corrected as shown below:

Column 16, line 37, delete the word "be" and substitute therefore the word --by--.

Column 17, line 50, delete the word "soil" and substitute therefore the word --coil--.

Column 20, lines 39 and 40, delete the word "conatiner" and substitute therefore the word --container--.

Column 22, line 66, delete the word "bailing" and substitute therefore the word --baling--.

Column 24, line 3, delete the numeral "247" and substitute therefore the numeral --274--.

UNITED STATES PATENT AND TRADEMARK OFFICE

CERTIFICATE OF CORRECTION

PATENT NO. : 5,111,741

DATED : May 12, 1992

INVENTOR(S) : Donald E. Weder, et al

It is certified that error appears in the above-indentified patent and that said Letters Patent is hereby corrected as shown below:

Column 26, line 23, delete the word "horiaontal" and substitute therefore the word —horizontal—.

Signed and Sealed this

Twenty-third Day of November, 1993

*Attest:*

Bruce Lehman

BRUCE LEHMAN

*Attesting Officer*

*Commissioner of Patents and Trademarks*